US011602206B1

(12) United States Patent
Troedson et al.

(10) Patent No.: US 11,602,206 B1
(45) Date of Patent: Mar. 14, 2023

(54) CASE FOR PORTABLE ELECTRONIC COMPUTING DEVICE

(71) Applicant: Pioneer Square Brands, Inc., Seattle, WA (US)

(72) Inventors: Emelie Elna Victoria Troedson, Seattle, WA (US); Brian Lewis Piper, Seattle, WA (US)

(73) Assignee: Pioneer Square Brands, Inc., Seattle, WA (US)

( * ) Notice: Subject to any disclaimer, the term of this patent is extended or adjusted under 35 U.S.C. 154(b) by 0 days.

(21) Appl. No.: 17/954,730

(22) Filed: Sep. 28, 2022

(51) Int. Cl.
*A45C 11/00* (2006.01)

(52) U.S. Cl.
CPC ..... *A45C 11/00* (2013.01); *A45C 2011/003* (2013.01)

(58) Field of Classification Search
CPC ..... A45C 11/00; A45C 2011/003; A45F 2200/0516; A45F 2200/0525
See application file for complete search history.

(56) References Cited

U.S. PATENT DOCUMENTS 5,547,388 A * 8/1996 Hill ..... H01R 13/6271 439/135
6,454,581 B1 * 9/2002 Ribeiro ..... B65D 39/00 439/135
7,189,084 B2 * 3/2007 Iikura ..... H04M 1/0274 439/135
7,500,866 B2 * 3/2009 Gennai ..... H04M 1/0274 439/367
7,572,993 B2 * 8/2009 Chen ..... H01R 13/5213 439/135
7,611,371 B2 * 11/2009 Guo ..... H01R 13/506 439/367
7,798,828 B2 * 9/2010 Kuo ..... H04M 1/0283 439/138
8,025,510 B2 * 9/2011 Bolshakov ..... H01R 13/443 439/136
8,186,726 B2 * 5/2012 Zuo ..... H04M 1/0274 292/DIG. 53
8,199,464 B2 * 6/2012 Zuo ..... H01R 13/447 361/679.01
8,199,470 B2 * 6/2012 Yang ..... H05K 5/03 455/575.8
8,395,887 B2 * 3/2013 Zhang ..... H01R 13/443 361/679.01
8,711,568 B2 * 4/2014 Evens ..... H01R 13/443 361/728
9,250,659 B2 * 2/2016 Tsai ..... G06F 1/1679
9,317,077 B2 * 4/2016 Mori ..... G06F 1/1616
9,560,782 B2 * 1/2017 Lee ..... H05K 5/061
9,795,044 B2 * 10/2017 Lai ..... H05K 5/0086
10,007,301 B2 * 6/2018 Iwamoto ..... H05K 5/03
(Continued)

*Primary Examiner* — Justin M Larson
(74) *Attorney, Agent, or Firm* — Grandview Law

(57) ABSTRACT

Systems and methods involve a portable electronic computing device, the system includes a case section including two apertures with a channel extending therebetween, and cover assembly including two plug portions with a mid portion extending therebetween, the two apertures, channel, two plug portions and mid portion sized and oriented, respectively, for coupling of the cover assembly with case section. In addition, other aspects are described in the claims, drawings, and text forming a part of the present disclosure.

13 Claims, 22 Drawing Sheets

(56) References Cited

U.S. PATENT DOCUMENTS

| | | | | |
|---|---|---|---|---|
| 10,050,374 | B1 * | 8/2018 | Lee | G06F 1/1656 |
| 10,194,725 | B2 * | 2/2019 | Lai | H04B 1/3888 |
| 10,429,898 | B2 * | 10/2019 | Yoshioka | G06F 1/1656 |
| 10,700,483 | B1 * | 6/2020 | Piper | G06F 1/1632 |
| 10,770,853 | B1 * | 9/2020 | Piper | H01R 31/06 |
| 10,827,809 | B2 * | 11/2020 | Skahan | A45C 11/00 |
| 11,068,023 | B1 * | 7/2021 | Manzano | G03B 11/04 |
| 11,083,100 | B2 * | 8/2021 | Shindo | G06F 1/1656 |
| 11,497,288 | B1 * | 11/2022 | Piper | A45C 11/00 |
| 2006/0154520 | A1 * | 7/2006 | Gennai | H01R 13/5213 439/578 |
| 2013/0271902 | A1 * | 10/2013 | Lai | H05K 5/0086 361/679.01 |
| 2015/0189963 | A1 * | 7/2015 | Lai | H04B 1/3888 224/191 |
| 2015/0229746 | A1 * | 8/2015 | Bergin | H04M 1/185 455/556.1 |
| 2022/0114287 | A1 * | 4/2022 | DiSalvo | G06F 1/1679 |

* cited by examiner

CASE FOR PORTABLE ELECTRONIC COMPUTING DEVICE

SUMMARY

In one or more aspects a system can include a system for a portable electronic computing device, the system includes (I) a case section including (A) at least one interior base surface, (B) a first side including at least one first interior wall portion and at least one first exterior side portion with the at least one first interior wall portion angularly extending relative to the at least one interior base surface, (C) a second side including at least one second interior wall portion and at least one second exterior side portion with the at least one second interior wall portion angularly extending relative to the at least one interior base surface, and (D) a third side including at least one third interior wall portion and at least one third exterior side portion with the at least one third interior wall portion angularly extending relative to the at least one interior base surface, wherein the at least one first interior wall portion extends perpendicularly to the second interior wall portion, and wherein the at least one first interior wall portion extends parallel with the at least one third interior wall portion, (E) a first aperture extending in a first direction through the at least one first interior wall portion and the at least one first exterior side portion of the first side, and (F) a channel extending parallel with and between at least a portion of the at least one first interior wall portion and at least a portion of the at least one first exterior side portion of the first side, the channel connecting with and extending from the first aperture in a second direction perpendicular with the first direction; and (II) a cover assembly including a first plug member shaped and sized to detachably couple with the first aperture of the case section, and an elongated member extending from the first plug member, at least a portion of the elongated member shaped and sized to detachably couple with the channel of the case section, the first plug member oriented with the elongated member to allow for simultaneous coupling of the first plug member with the first aperture and the at least a portion of the elongated member with the channel. Wherein the case section further includes a second aperture extending in a third direction parallel with the first direction through the at least one first interior wall portion and the at least one first exterior side portion of the first side, the channel connecting with and extending from the second aperture in a fourth direction opposite of the second direction. Wherein the elongated member of the cover assembly further includes a second plug portion shaped and sized to detachably couple with the second aperture of the case section, the second plug portion oriented with the first plug member of the first plug member to allow for simultaneous coupling of the first plug member of the cover assembly with the first aperture of the case section and the second plug portion of the elongated member with the second aperture of the case section. Wherein the elongated member of the cover assembly further includes a mid portion extending between the second plug portion of the elongated member and the first plug member of the cover assembly, the mid portion shaped and sized to allow for simultaneous positioning of the mid portion within the channel, coupling of the first plug member of the cover assembly with the first aperture of the case section and the second plug portion of the elongated member with the second aperture of the case section. Wherein (a) the channel of the case section includes a first dimensional width, and (b) the second aperture includes a second dimensional width being larger than the first dimensional width of the channel. Wherein (a) the mid portion of the elongated member includes a third dimensional width to allow for positioning of the mid portion of the elongated member within the channel, and (b) the second plug portion of the elongated member includes a fourth dimensional width to allow for positioning of the second plug portion in the second aperture, the fourth dimensional width of the second plug portion of the elongated member being larger than the third dimensional width of the mid portion of the elongated member. Wherein the channel of the cover section includes a first side and a second side and includes a bridge member extending from the first side to the second side. Wherein the bridge member of the case section being so positioned to allow for simultaneous contact of a portion of the bridge member with a portion of the mid portion of the elongated member of the cover assembly and positioning of at least a portion of the elongated member in the channel. Wherein the mid portion of the elongated member of the cover assembly includes a corrugated portion. Wherein the corrugated portion includes at least one ridge, the ridge being positioned to allow simultaneous contact of the ridge with the bridge member and positioning of the at least a portion of the elongated member in the channel. Wherein the first aperture of the case section assembly includes an elongated depression with tapered sides. Wherein the first plug member of the cover assembly includes an elongated member with tapered sides. Wherein the case section includes at least one of the following materials: rigid plastic, polycarbonate, acrylonitrile butadiene styrene, thermoplastic polymer, polyethylene terephthalate, and nylon, and wherein the cover assembly includes at least one of the following materials: silicone, thermoplastic polyurethane, and thermoplastic elastomer.

In one or more aspects, a system for a portable electronic computing device, the system includes (I) a case section including (A) at least one interior base surface, (B) a first side including at least one first interior wall portion and at least one first exterior side portion with the at least one first interior wall portion angularly extending relative to the at least one interior base surface, (C) a second side including at least one second interior wall portion and at least one second exterior side portion with the at least one second interior wall portion angularly extending relative to the at least one interior base surface, and (D) a third side including at least one third interior wall portion and at least one third exterior side portion with the at least one third interior wall portion angularly extending relative to the at least one interior base surface, wherein the at least one first interior wall portion extends perpendicularly to the second interior wall portion, and wherein the at least one first interior wall portion extends parallel with the at least one third interior wall portion such that the case section being configured to receive the first portion of the portable electronic computing device, (E) a first aperture extending in a first direction through the at least one first interior wall portion and the at least one first exterior side portion of the first side, and (F) a channel extending parallel with and between at least a portion of the at least one first interior wall portion and at least a portion of the at least one first exterior side portion of the first side, the channel connecting with and extending from the first aperture in a second direction perpendicular with the first direction. Wherein the case section further includes a second aperture extending in a third direction parallel with the first direction through the at least one first interior wall portion and the at least one first exterior side portion of the first side, the channel connecting with and extending from the second aperture in a fourth direction opposite of the second direction. Wherein (a) the channel of the case section includes a first dimensional width, and (b) the second aperture includes a second dimensional width being larger than the first dimensional width of the channel. Wherein the channel of the cover section includes a first side and a second side and includes a bridge member extending from the first side to the second side.

In one or more aspects, a system for a portable electronic computing device, the system includes (I) a cover assembly including a first plug member, and an elongated member extending from the first plug member wherein the elongated member of the cover assembly further includes a second plug portion including a first dimensional width, a mid portion extending between the second plug portion of the elongated member and the first plug member of the cover assembly, the mid portion of the elongated member including a second dimensional width, the first dimensional width of the second plug portion of the elongated member being larger than the second dimensional width of the mid portion of the elongated member. Wherein the second plug portion of the elongated member being shaped as a slab. Wherein the mid portion of the elongated member of the cover assembly includes at least one corrugated shaped portion.

In addition to the foregoing, other aspects are described in the claims, drawings, and text forming a part of the disclosure set forth herein. Various other aspects are set forth and described in the teachings such as text (e.g., claims and/or detailed description) and/or drawings of the present disclosure. The foregoing is a summary and thus may contain simplifications, generalizations, inclusions, or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

With reference now to the figures, shown are one or more examples of a case for portable electronic computing device systems, articles of manufacture, compositions of matter for same that may provide context, for instance, in introducing one or more processes and/or devices described herein.

DETAILED DESCRIPTION

Figure 1:
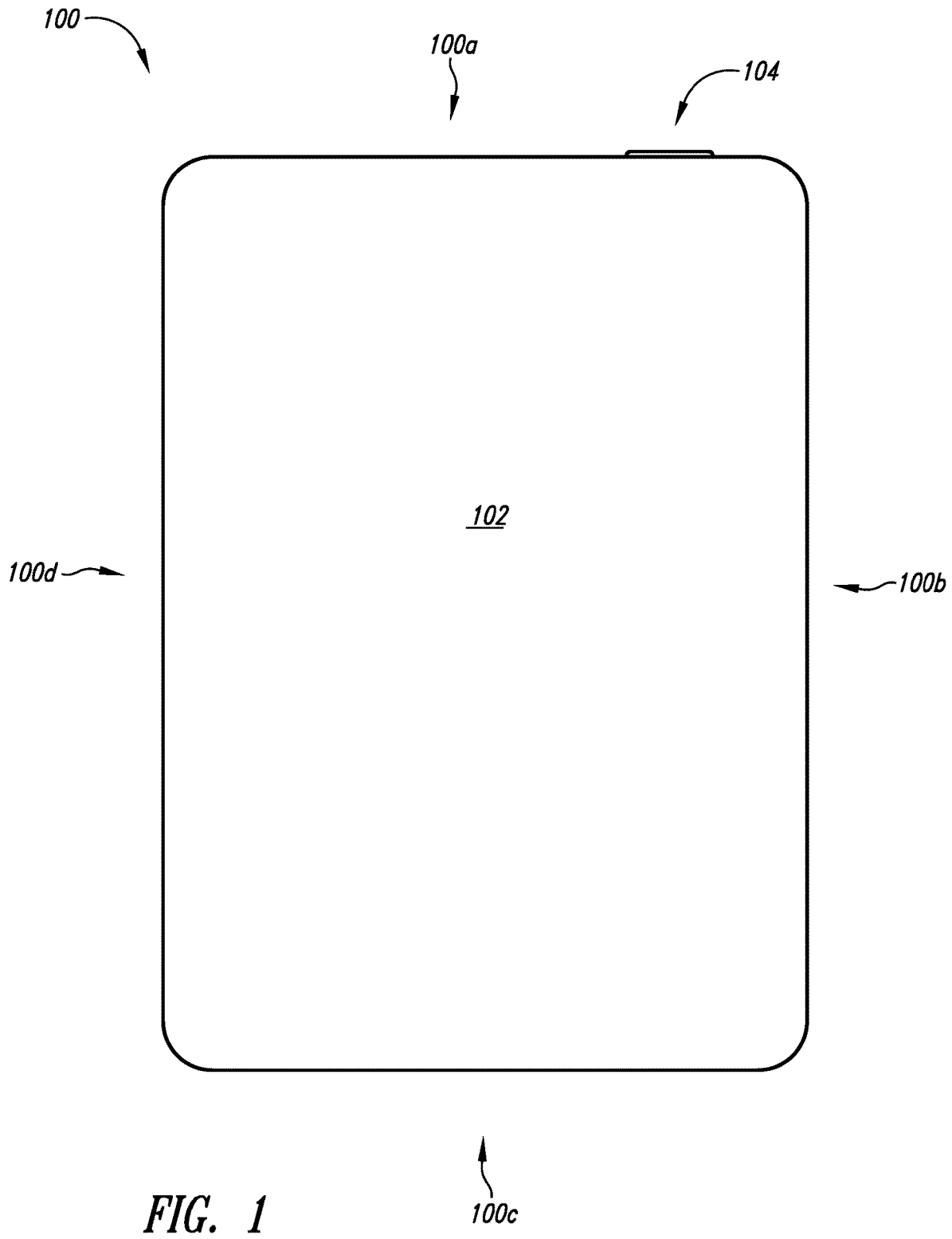
FIG. 1 is a front elevational view of a conventional portable electronic device.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is a front elevational view of a conventional portable electronic device such as but not limited to a tablet, a laptop, etc. In implementations, portable electronic device 100 is shown to include side 100*a*, side 100*b*, side 100*c*, side 100*d*, display surface 102, and scanner input 104.

Figure 2:
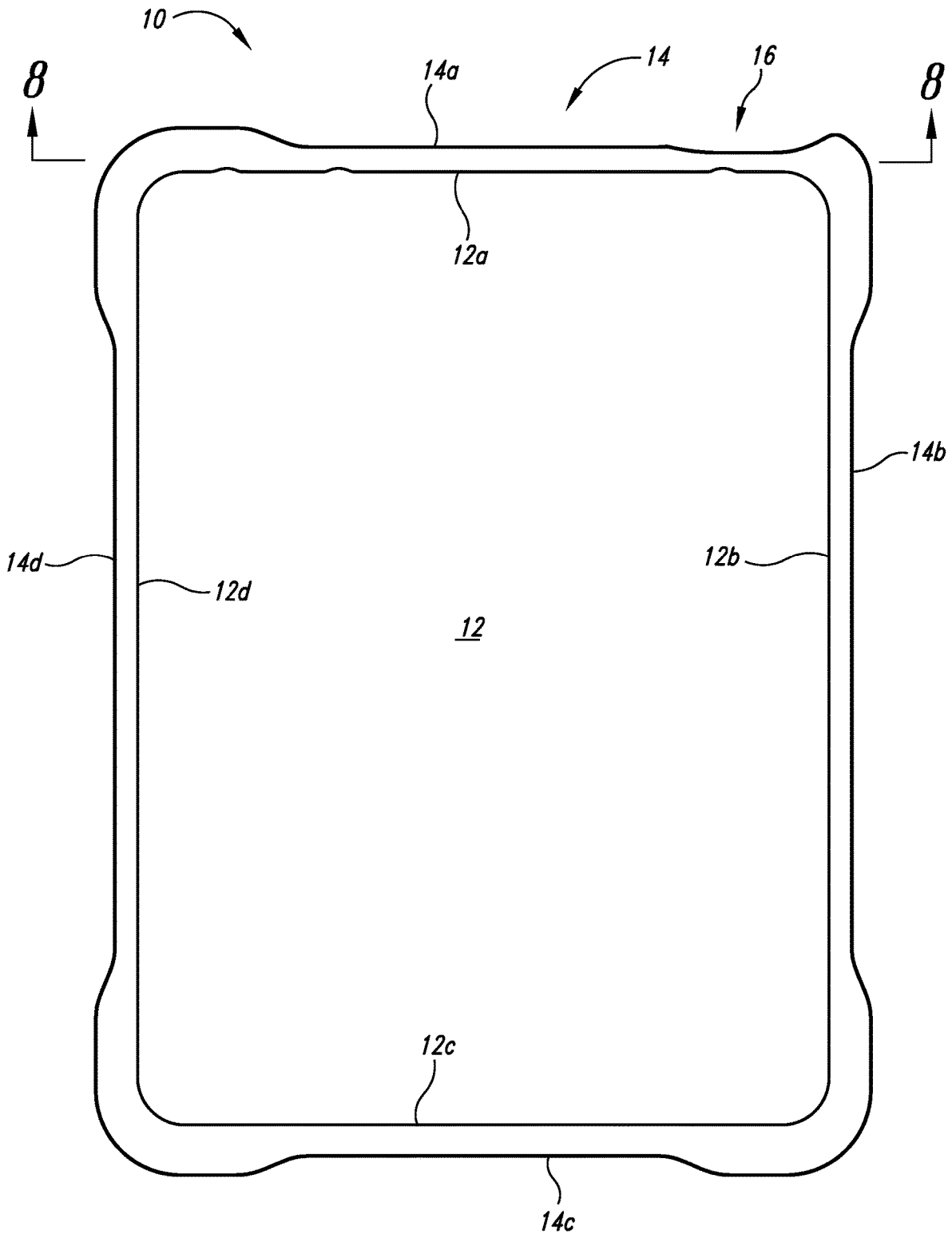
FIG. 2 is a front elevational view of a case assembly for a portable electronic device.

Turning to FIG. 2, depicted therein is a front elevational view of a case assembly for a portable electronic device. In implementations, device case assembly 10 is shown to include interior base surface 12, exterior 14, and aperture assembly 16. The interior base surface 12 is shown to include interior wall portion 12*a*, interior wall portion 12*b*, interior wall portion 12*c*, and interior wall portion 12*d*. The exterior 14 is shown to include exterior side portion 14*a*, exterior side portion 14*b*, exterior side portion 14*c*, and exterior side portion 14*d*.

Figure 3:
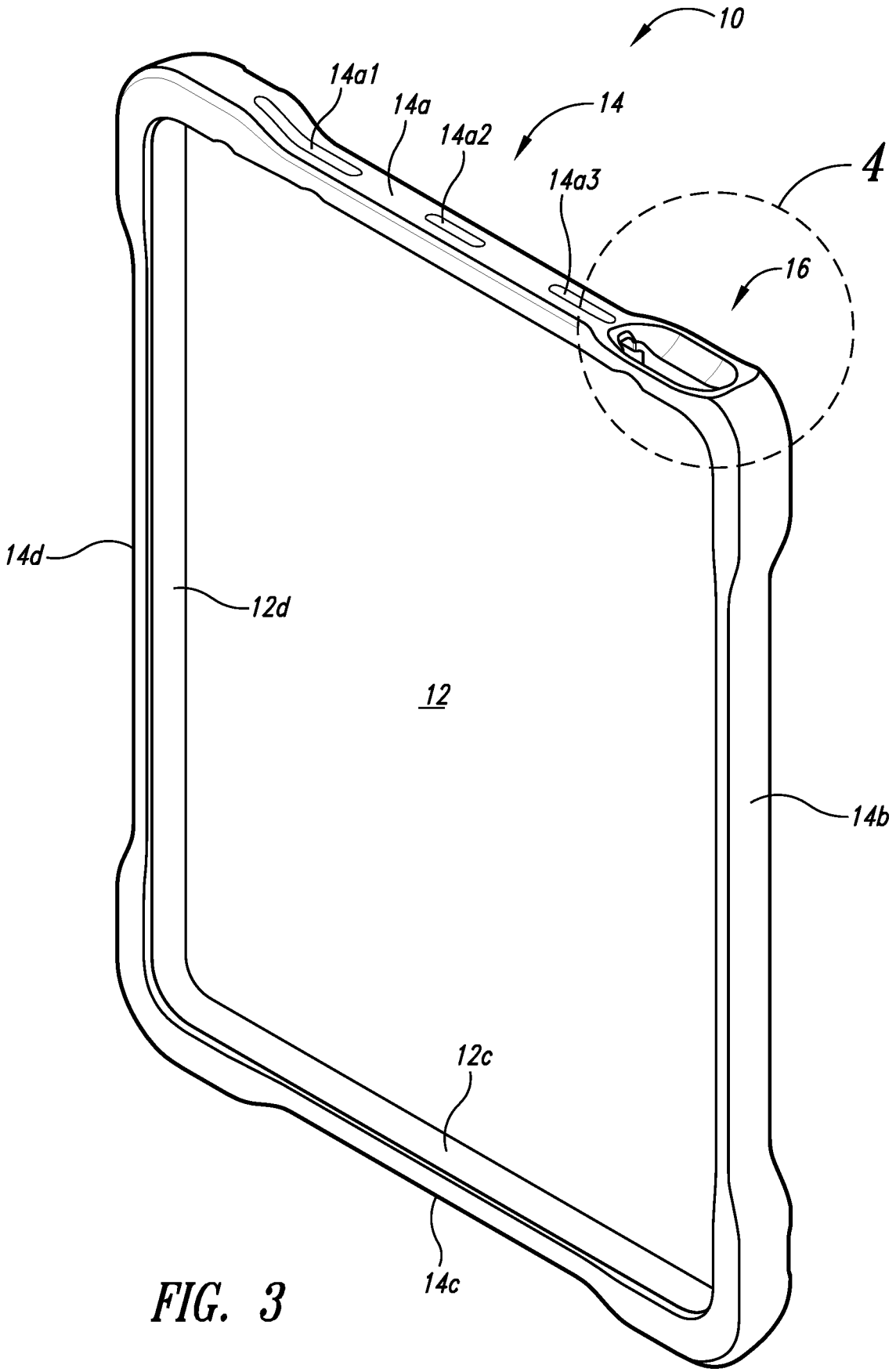
FIG. 3 is a perspective view of the case assembly of FIG. 2.

Turning to FIG. 3, depicted therein is a perspective view of the case assembly of FIG. 2. In implementations, exterior side portion 14*a* is shown to include aperture 14*a*1, aperture 14*a*2, and aperture 14*a*3.

Figure 4:
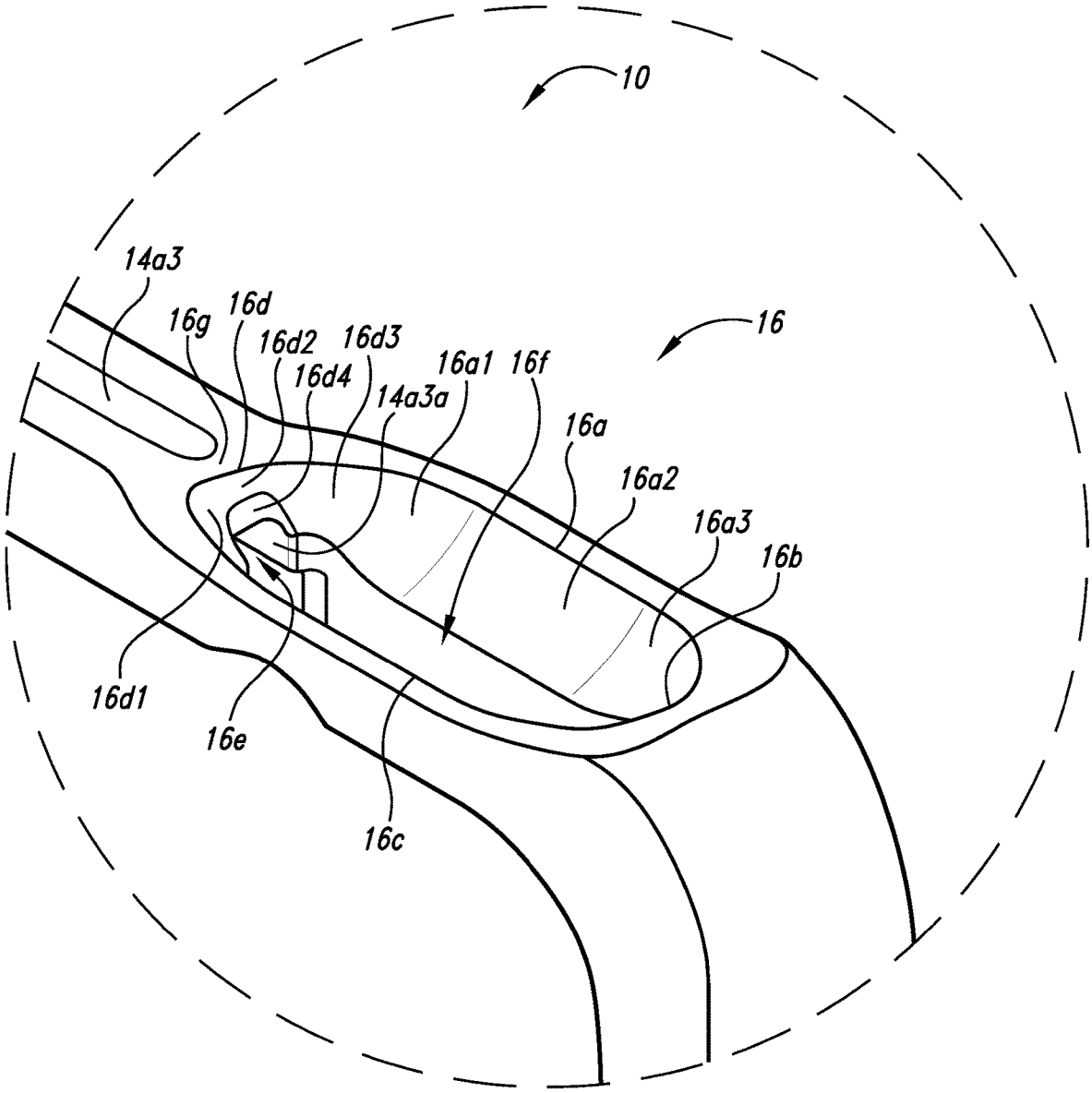
FIG. 4 is an enlarged perspective view of a dashed-circle portion of the case assembly labeled "4" shown in FIG. 3.

Turning to FIG. 4, depicted therein is an enlarged perspective view of a dashed-circle portion of the case assembly labeled "4" shown in FIG. 3. In implementations, aperture assembly 16 is shown to include side 16*a*, side 16*b*, and side 16*c*, side 16*d*, and aperture 16*f*. The side 16*a* is shown to include corner portion 16*a*1, side portion 16*a*2, and corner portion 16*a*3. The side 16*d* is shown to include corner portion 16*d*1, side portion 16*d*2, and corner portion 16*d*3, and side portion 16*d*4. The exterior side portion 14*a* is shown to include channel 16*e*, aperture 16*f*, and bridge member 16*g*. The channel 16*e* is shown to include side 14*a*3*a*.

Figure 5:
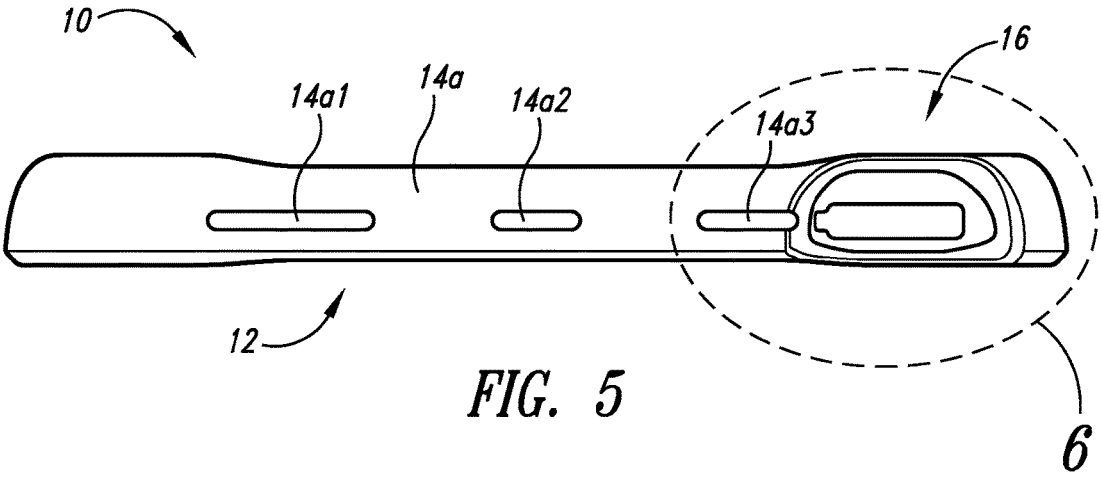
FIG. 5 is a side-elevational view of the case assembly of FIG. 4.

Turning to FIG. 5, depicted therein is a side-elevational view of the case assembly of FIG. 4.

Figure 6:
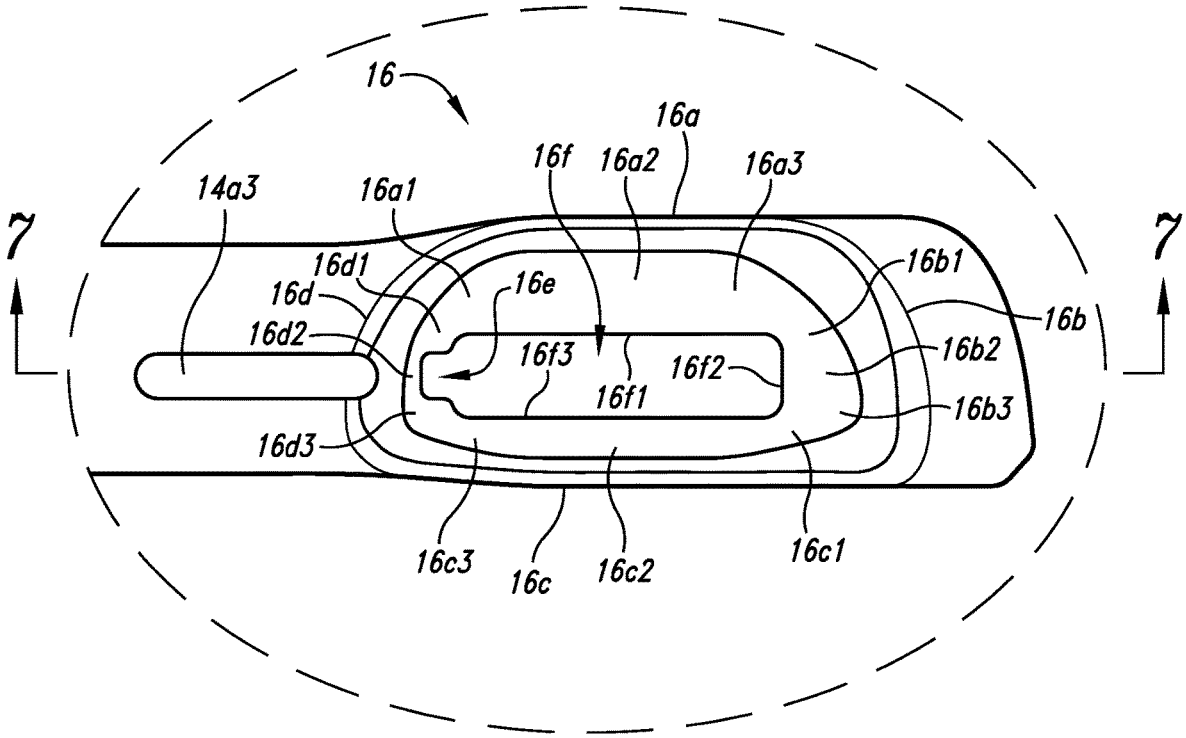
FIG. 6 is an enlarged side-elevational view of a dashed-circle portion of the case assembly labeled "6" shown in FIG. 5.

Turning to FIG. 6, depicted therein is an enlarged side-elevational view of a dashed-circle portion of the case assembly labeled "6" shown in FIG. 5. In implementations, side 16*b* is shown to include corner portion 16*b*1, side portion 16*b*2, and corner portion 16*b*3. In implementations, side 16*c* is shown to include corner portion 16*c*1, side portion 16*b*2, and corner portion 16*c*3. In implementations, aperture 16*f* is shown to include side portion 16*f*1, side portion 16*f*2, and side portion 16*f*3.

Figure 7:
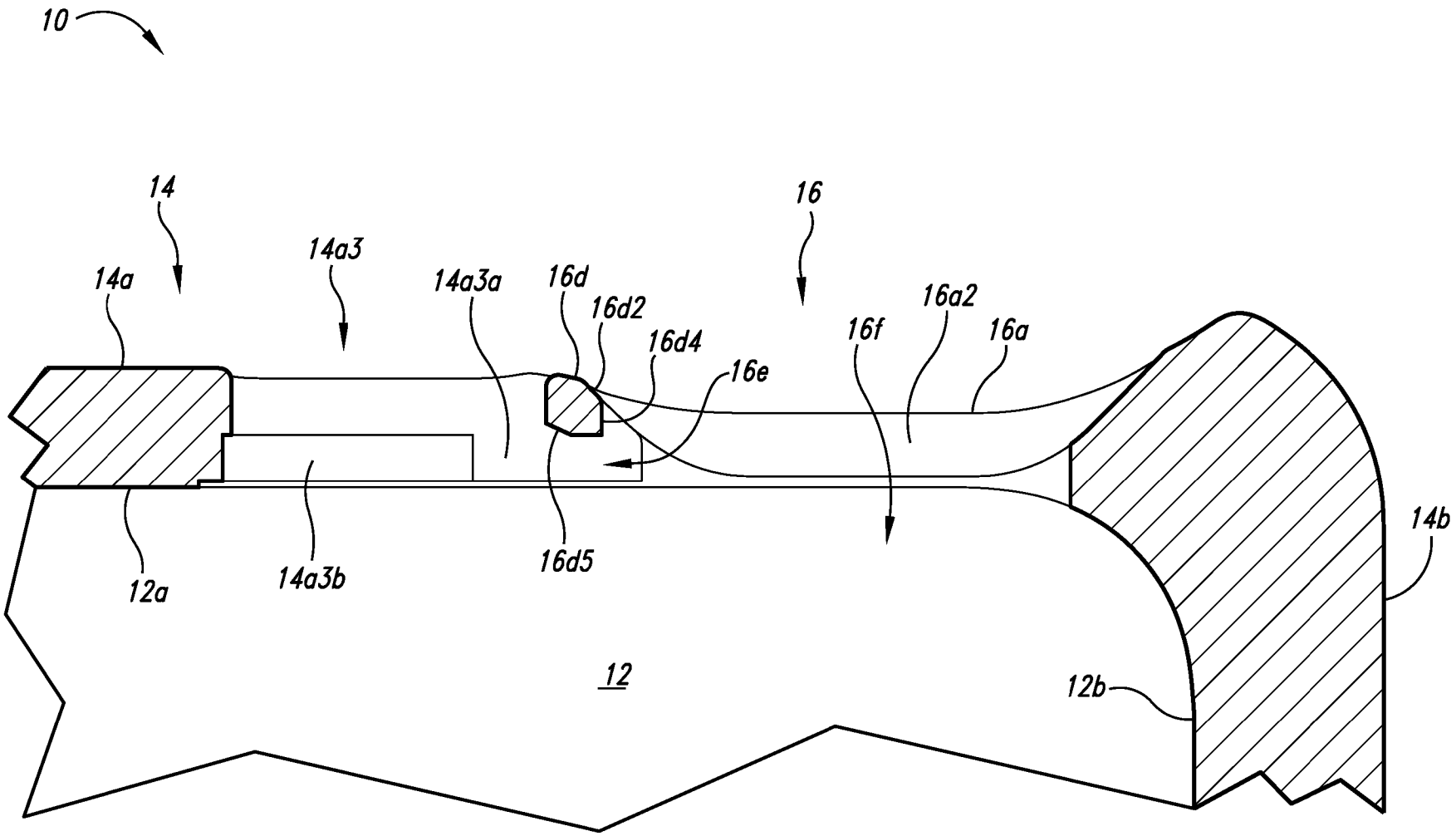
FIG. 7 is a cross-sectional side-elevational view of the case assembly taken along the 7-7 cut line of FIG. 6.

Turning to FIG. 7, depicted therein is a cross-sectional side-elevational view of the case assembly taken along the 7-7 cut line of FIG. 6. In implementations, exterior side portion 14*a* is shown to include insert portion 7.14*a*3*b*. In implementations bridge member 16*g* is shown to include side portion 16*d*5.

Figure 8:
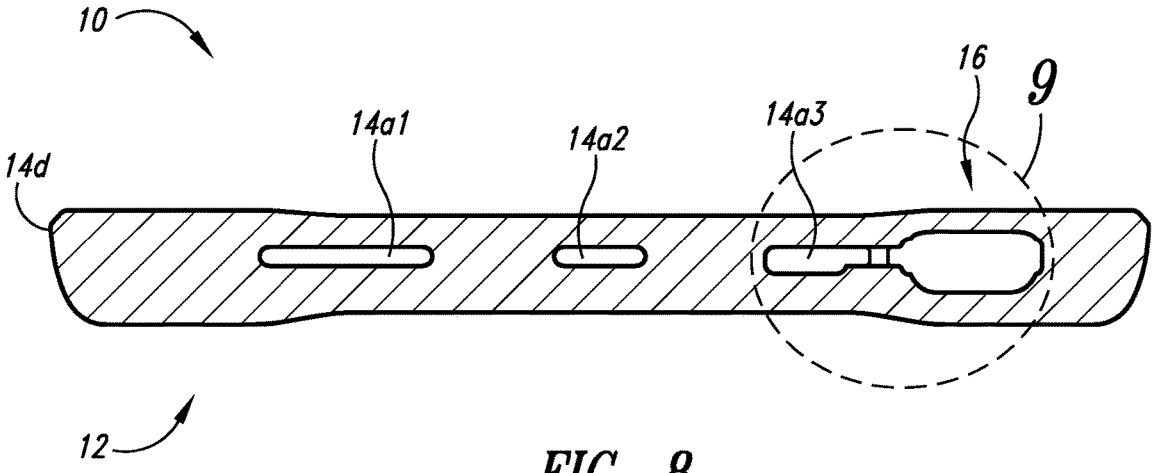
FIG. 8 is a cross-sectional side-elevational view of the case assembly taken along the 8-8 cut line of FIG. 2.

Turning to FIG. 8, depicted therein is a cross-sectional side-elevational view of the case assembly taken along the 8-8 cut line of FIG. 2.

Figure 9:
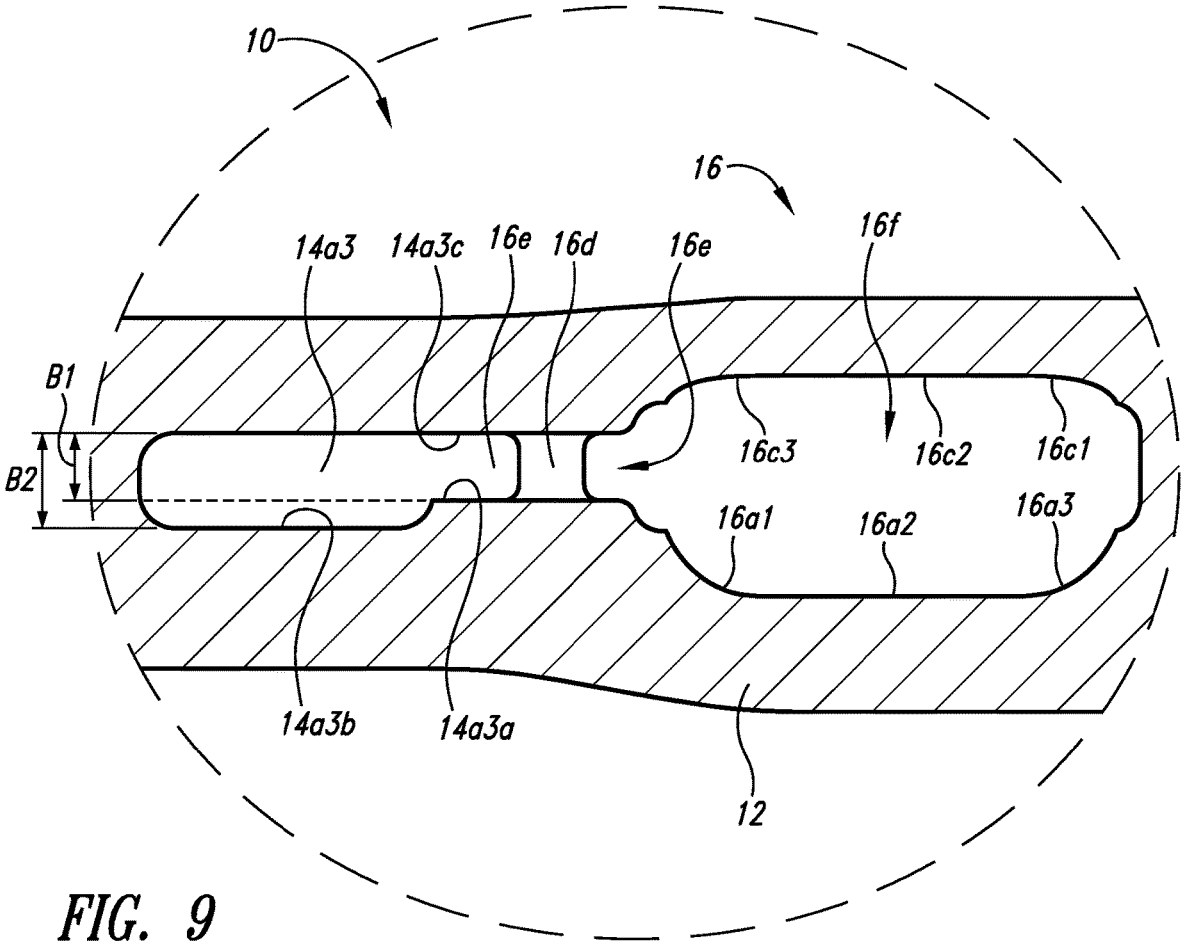
FIG. 9 is an enlarged side-elevational view of a dashed-circle portion of the case assembly labeled "9" shown in FIG. 8.

Turning to FIG. 9, depicted therein is an enlarged side-elevational view of a dashed-circle portion of the case assembly labeled "9" shown in FIG. 8. In implementations, channel 16*e* is shown to include side 14*a*3*c* and linear dimension B1. The aperture 14*a*3 is shown to include linear dimension B2.

Figure 10:
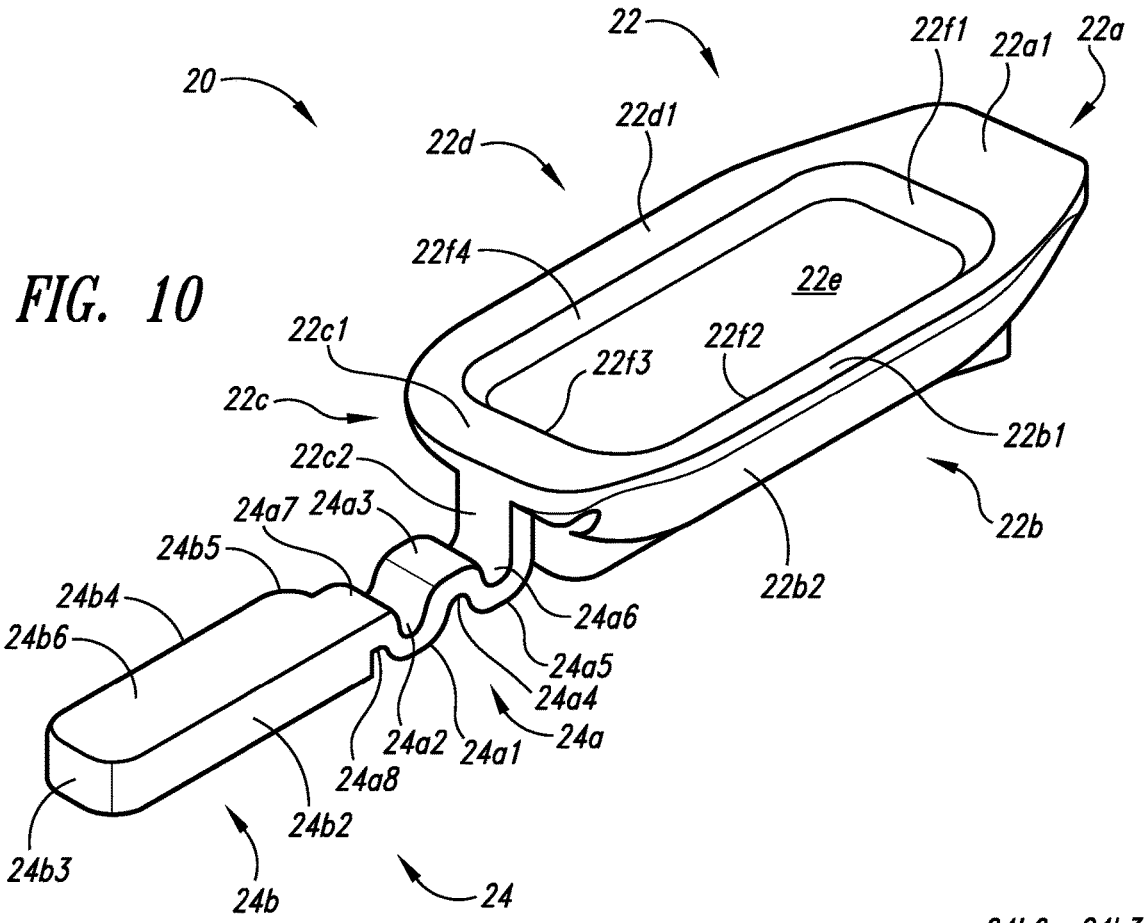
FIG. 10 is an upper-rear perspective view of a cover assembly.

Turning to FIG. 10, depicted therein is an upper-rear perspective view of a cover assembly. In implementations, cover assembly 20 is shown to include plug member 22 and elongated member 24. In implementations, plug member 22 is shown to include side 22*a*, side 22*b*, side 22*c*, side 22*d*, and base portion 22*e*. The side 22*a* is shown to include rim portion 22*a*1.

The side 22*b* is shown to include rim portion 22*b*1 and side portion 22*b*2. The side 22*c* is shown to include rim portion 22*c*1 and side portion 22*c*2. The side 22*d* is shown to include rim portion 22*d*1. The base portion 22*e* is shown to be bounded by side 22*f*1, side 22*f*2, side 22*f*3, and side 22*f*4.

In implementations, elongated member 24 is shown to include mid portion 24*a* and plug portion 24*b*. The mid portion 24*a* is shown to include ridge portion 24*a*1, groove portion 24*a*2, ridge portion 24*a*3, groove portion 24*a*4, ridge portion 24*a*5, groove portion 24*a*6, ridge portion 24*a*7, and groove portion 24*a*8 having corrugated shape.

The plug portion 24*b* is shown to include side portion 24*b*2, end portion 24*b*3, side portion 24*b*4, corner portion 24*b*5, and side portion 24*b*6 having a slab shape. The side 22*d* is shown to include rim portion 22*d*1. The base portion 22*e* is shown to be bounded by side 22*f*1, side 22*f*2, side 22*f*3, and side 22*f*4.

The exterior 14 is shown to include exterior side portion 14*a*, exterior side portion 14*b*, exterior side portion 14*c*, and exterior side portion 14*d*.

Figure 11:
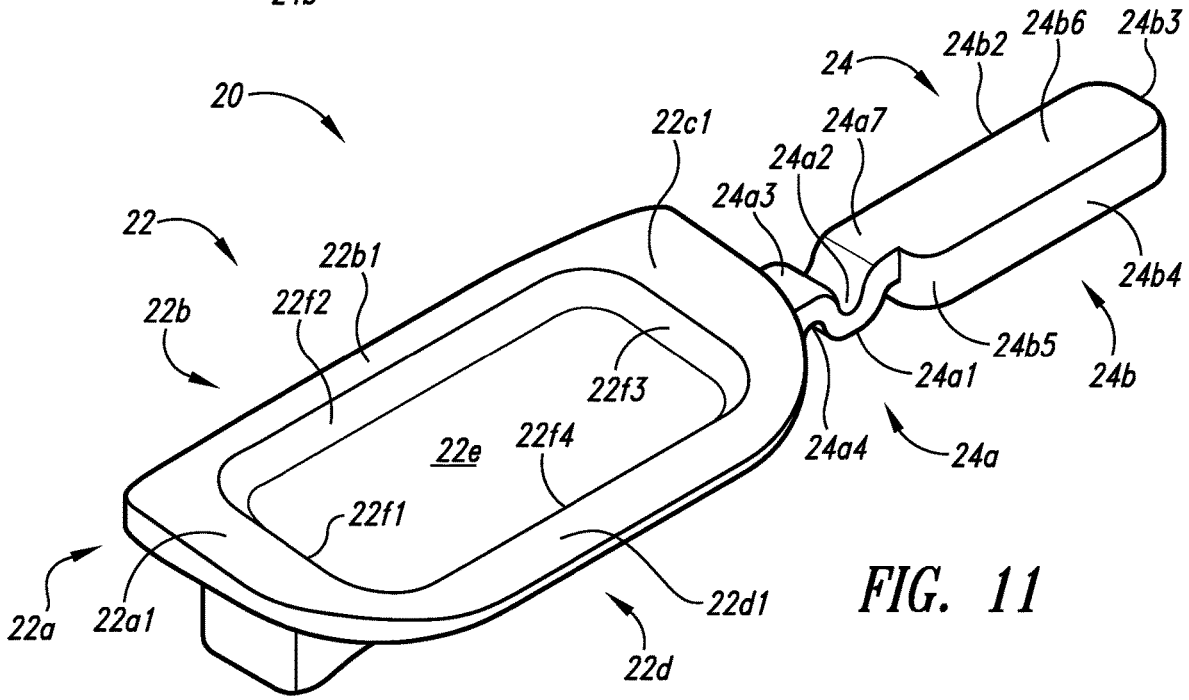
FIG. 11 is an upper-front perspective view of the cover assembly of FIG. 10.

Turning to FIG. 11, depicted therein is an upper-front perspective view of the cover assembly of FIG. 10.

Figure 12:
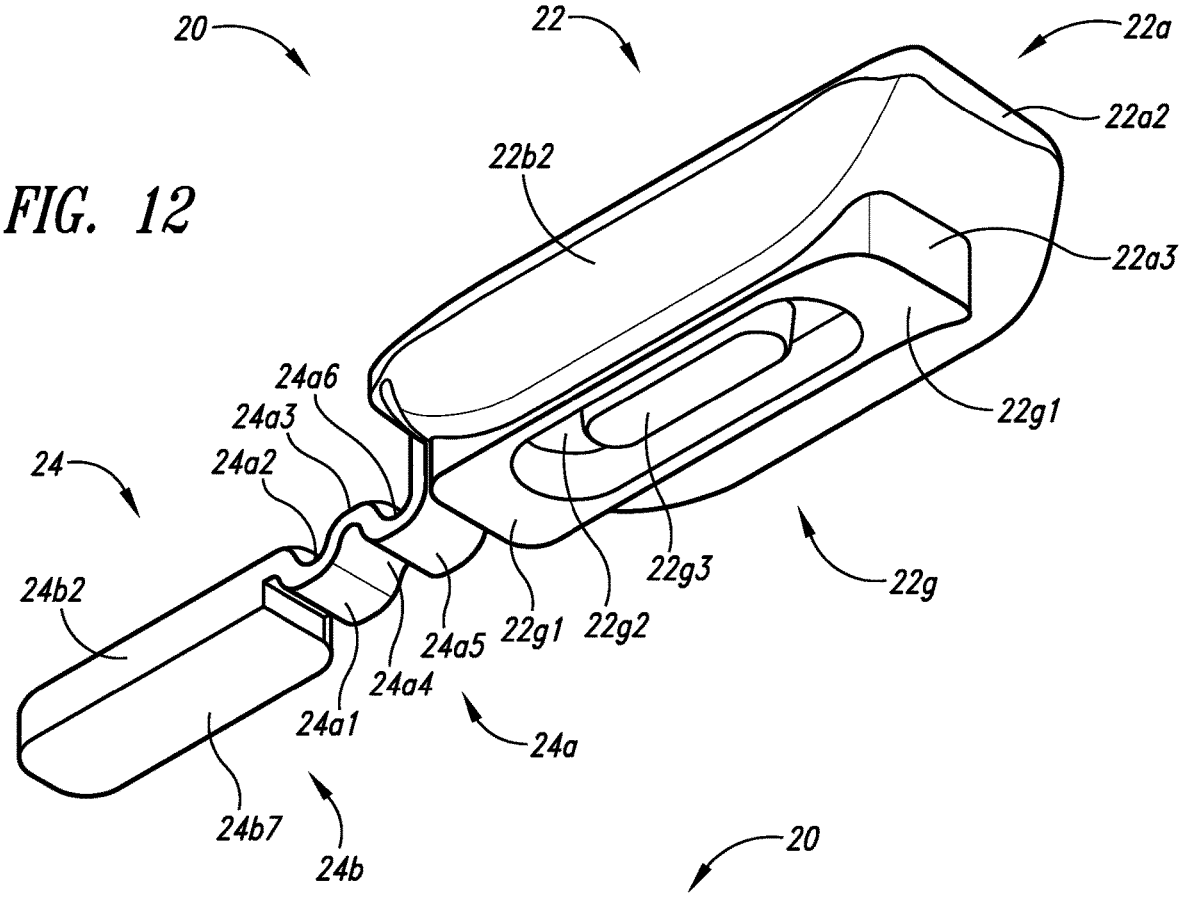
FIG. 12 is a lower-front perspective view of the cover assembly of FIG. 10.

Turning to FIG. 12, depicted therein is a lower-front perspective view of the cover assembly of FIG. 10. In implementations, side 22*a* is shown to include side portion 22*a*2 and side portion 22*a*3. In implementations, side 22*b* is shown to include side portion 22*b*2. In implementations, plug member 22 is shown to include lower portion 22*g*. The lower portion 22*g* is shown to include lower surface 22*g*1, indent portion 22*g*2, and center portion 22*g*3. The plug portion 24*b* is shown to include side portion 24*b*7.

Figure 13:
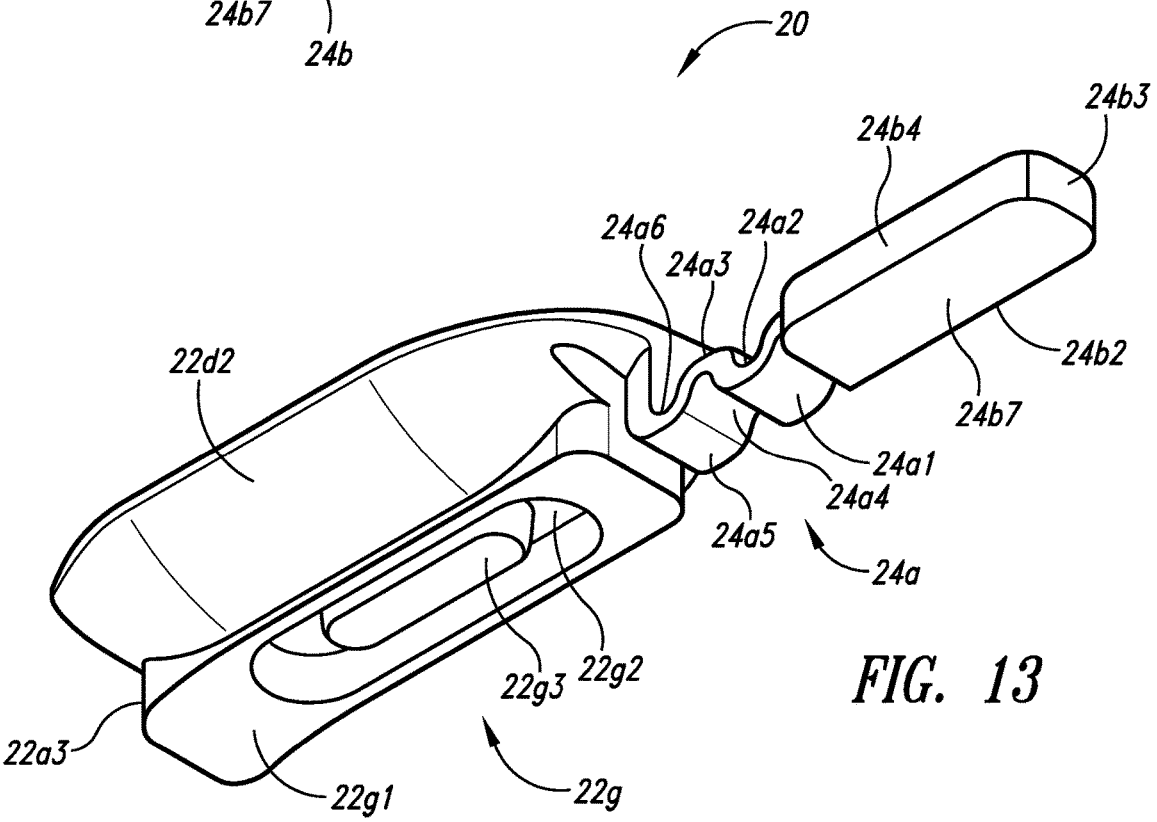
FIG. 13 is a lower-rear perspective view of the cover assembly of FIG. 10.

Turning to FIG. 13, depicted therein is a lower-rear perspective view of the cover assembly of FIG. 10. The side 22*d* is shown to include side portion 22*d*2.

Figure 14:
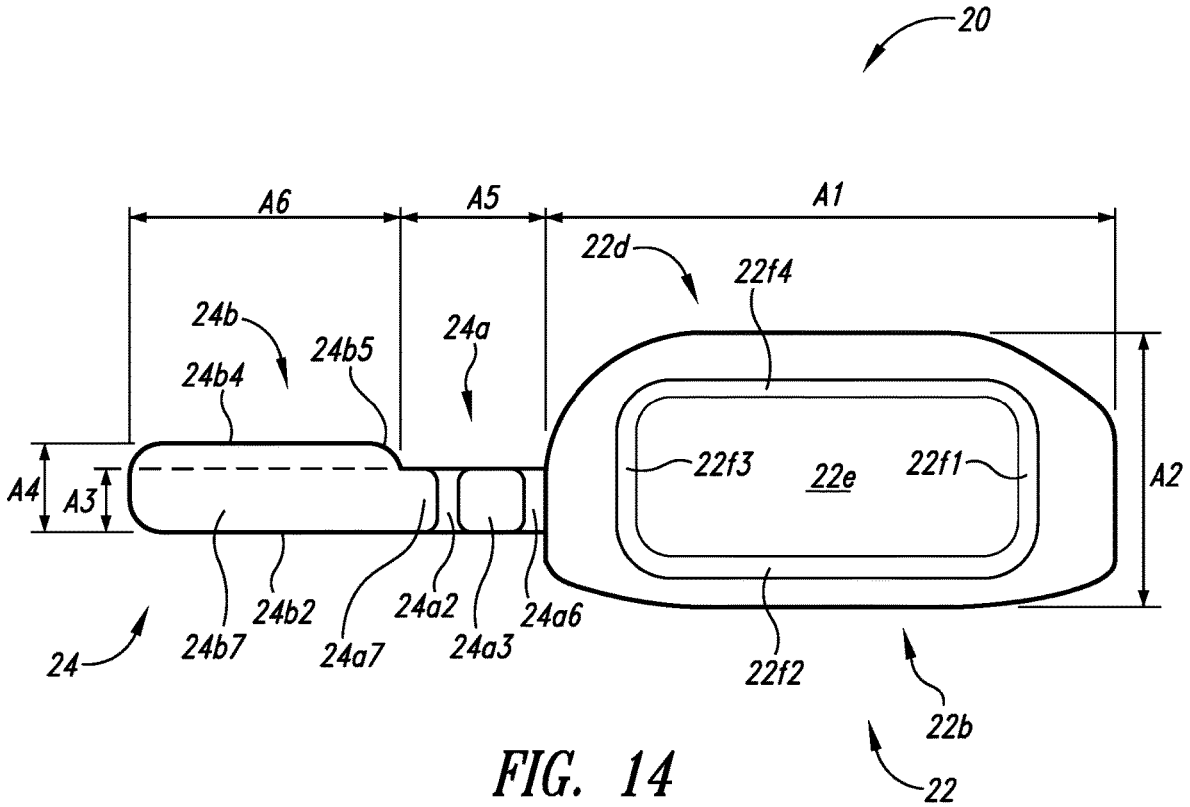
FIG. 14 is a top plan view of the cover assembly of FIG. 10.

Turning to FIG. 14, depicted therein is a top plan view of the cover assembly of FIG. 10. In implementations, cover assembly 20 is shown to include linear dimension A1, linear dimension A2, linear dimension A3, linear dimension A4, linear dimension A5, and linear dimension A6.

Figure 15:
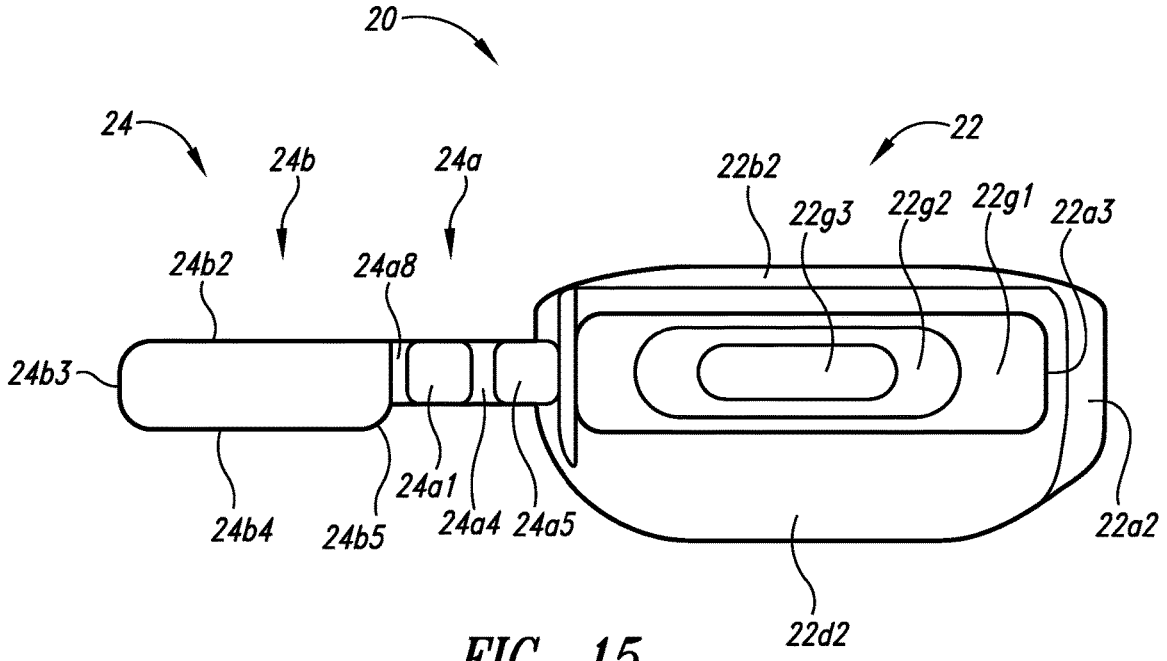
FIG. 15 is a bottom plan view of the cover assembly of FIG. 10.

Turning to FIG. 15, depicted therein is a bottom plan view of the cover assembly of FIG. 10.

Figure 16:
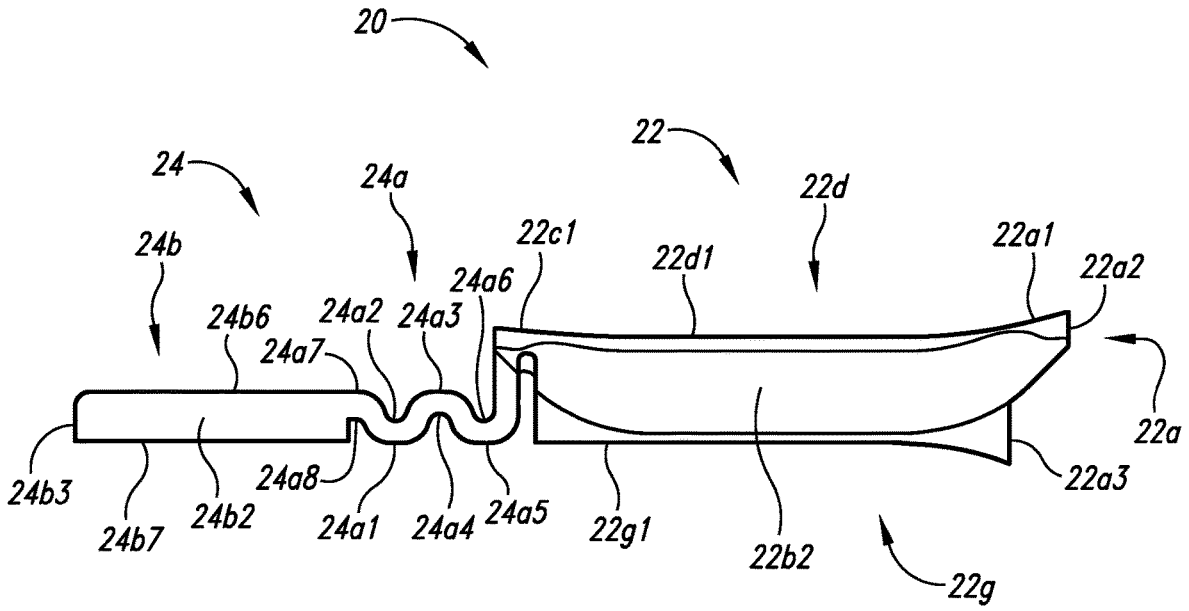
FIG. 16 is a lefthand side-elevational view of the cover assembly of FIG. 10.

Turning to FIG. 16, depicted therein is a lefthand side-elevational view of the cover assembly of FIG. 10.

Figure 17:
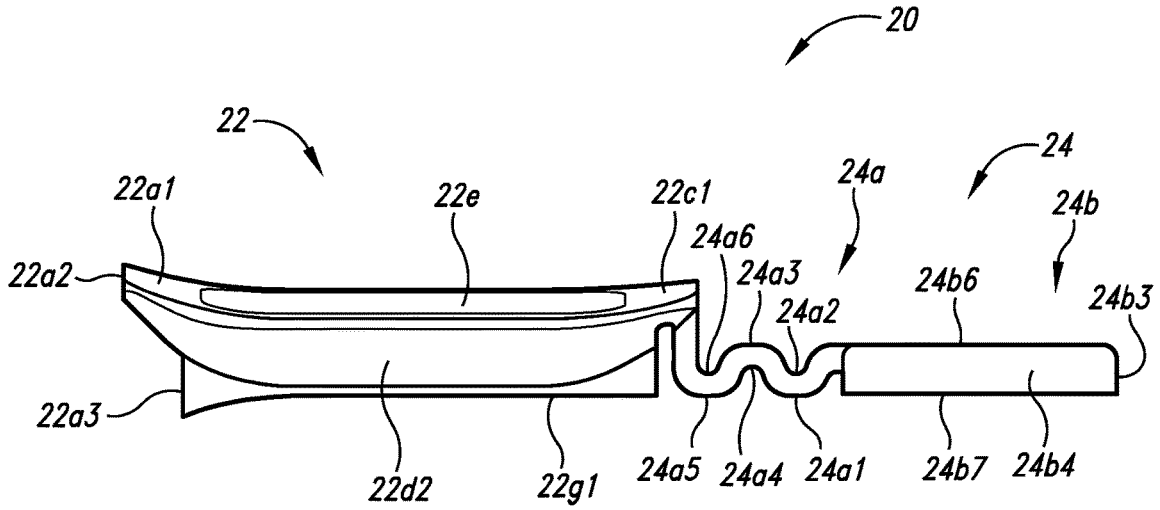
FIG. 17 is a righthand side-elevational view of the cover assembly of FIG. 10.

Turning to FIG. 17, depicted therein is a righthand side-elevational view of the cover assembly of FIG. 10.

Figure 18:
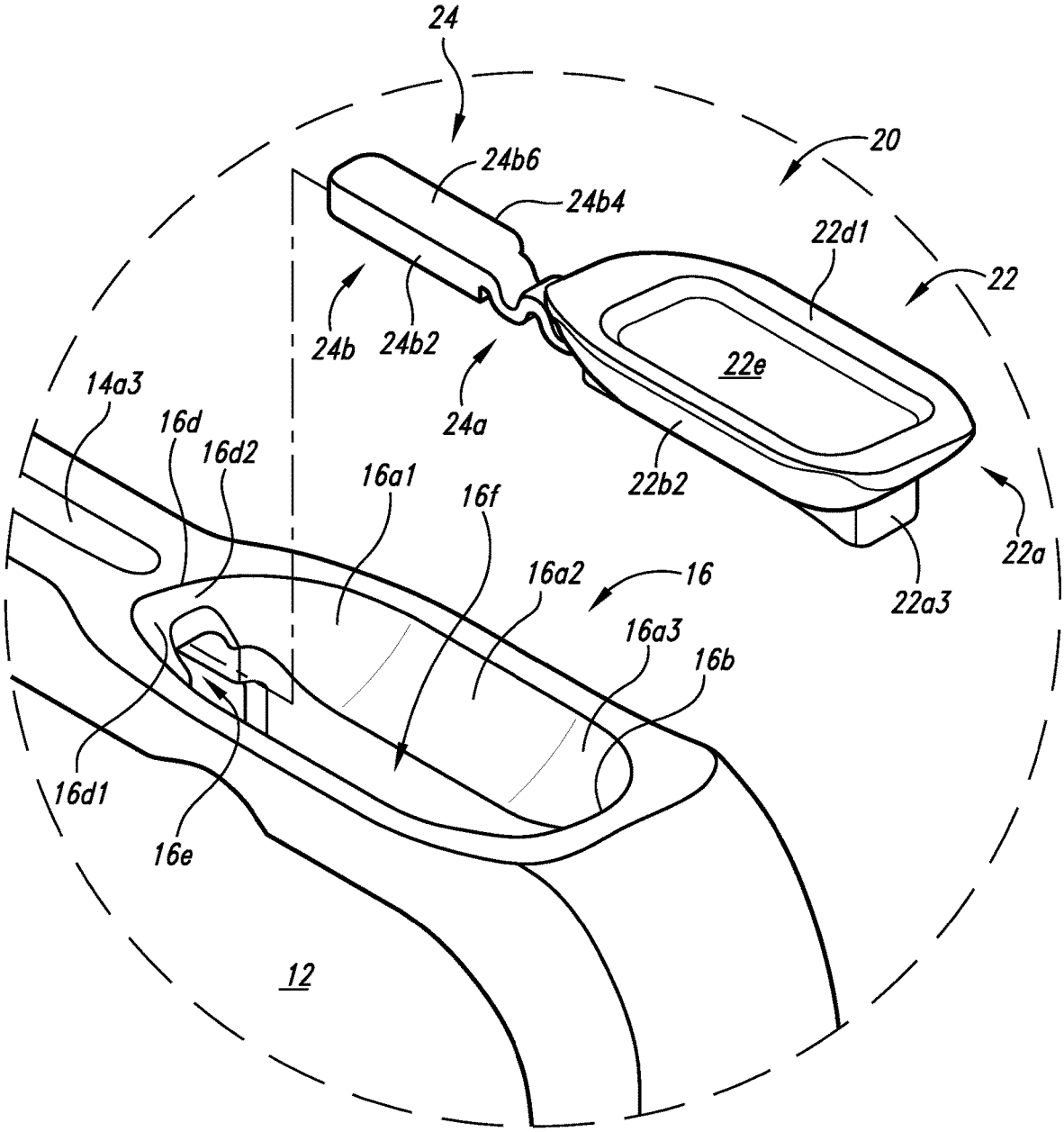
FIG. 18 is an enlarged perspective view of the cover assembly of FIG. 10 and a portion of the case assembly of FIG. 2 with the cover assembly prior to coupling with the case assembly.

Turning to FIG. 18, depicted therein is an enlarged perspective view of the cover assembly of FIG. 10 and a portion of the case assembly of FIG. 2 with the cover assembly prior to coupling with the case assembly.

Figure 19:
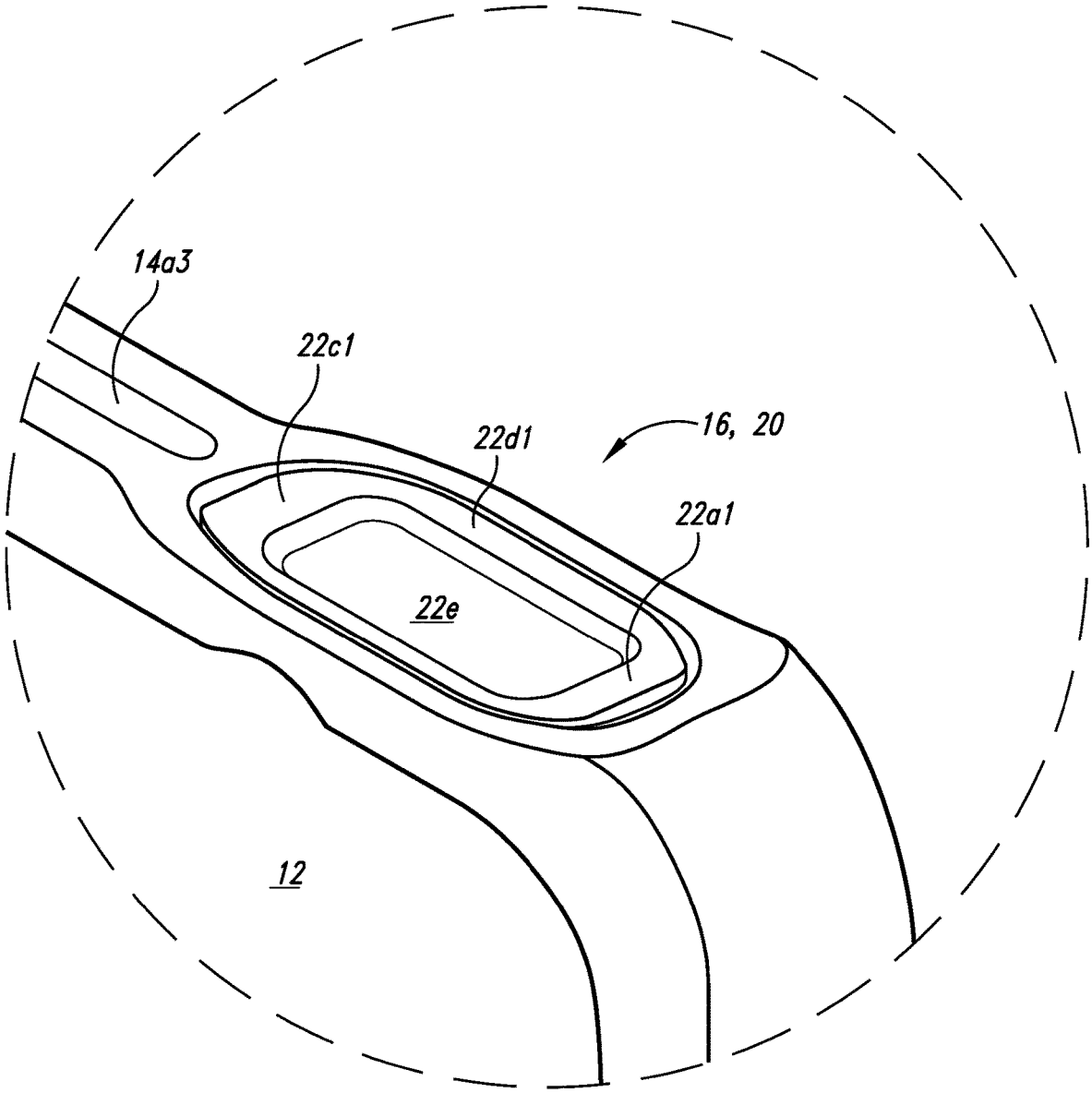
FIG. 19 is an enlarged perspective view of the cover assembly of FIG. 10 and a portion of the case assembly of FIG. 2 with the cover assembly coupled with the case assembly.

Turning to FIG. 19, depicted therein is an enlarged perspective view of the cover assembly of FIG. 10 and a portion of the case assembly of FIG. 2 with the cover assembly coupled with the case assembly.

Figure 20:
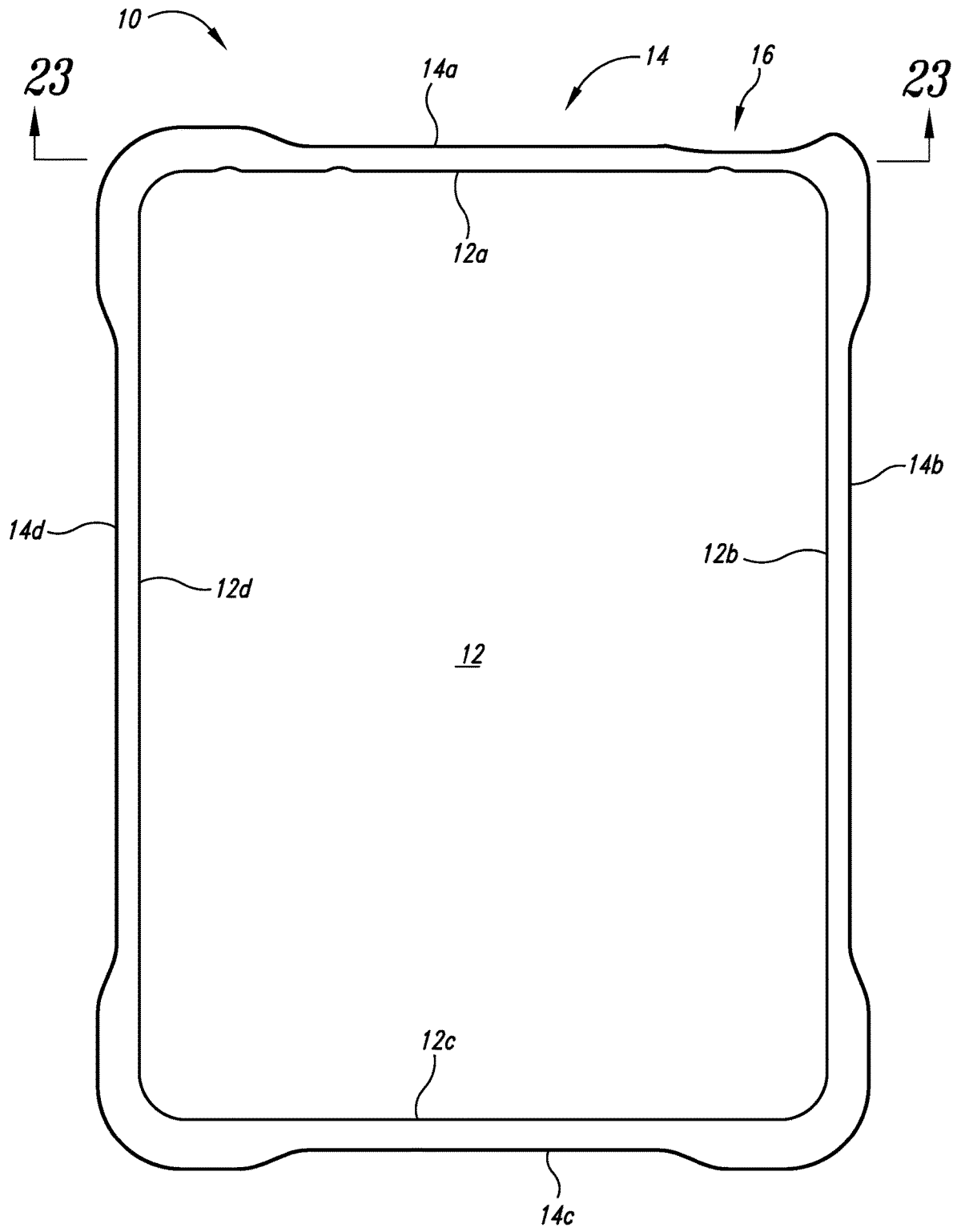
FIG. 20 is a front elevational view of the case assembly of FIG. 2 coupled with the cover assembly of FIG. 10.

Turning to FIG. 20, depicted therein is a front elevational view of the case assembly of FIG. 2 coupled with the cover assembly of FIG. 10.

Figure 21:
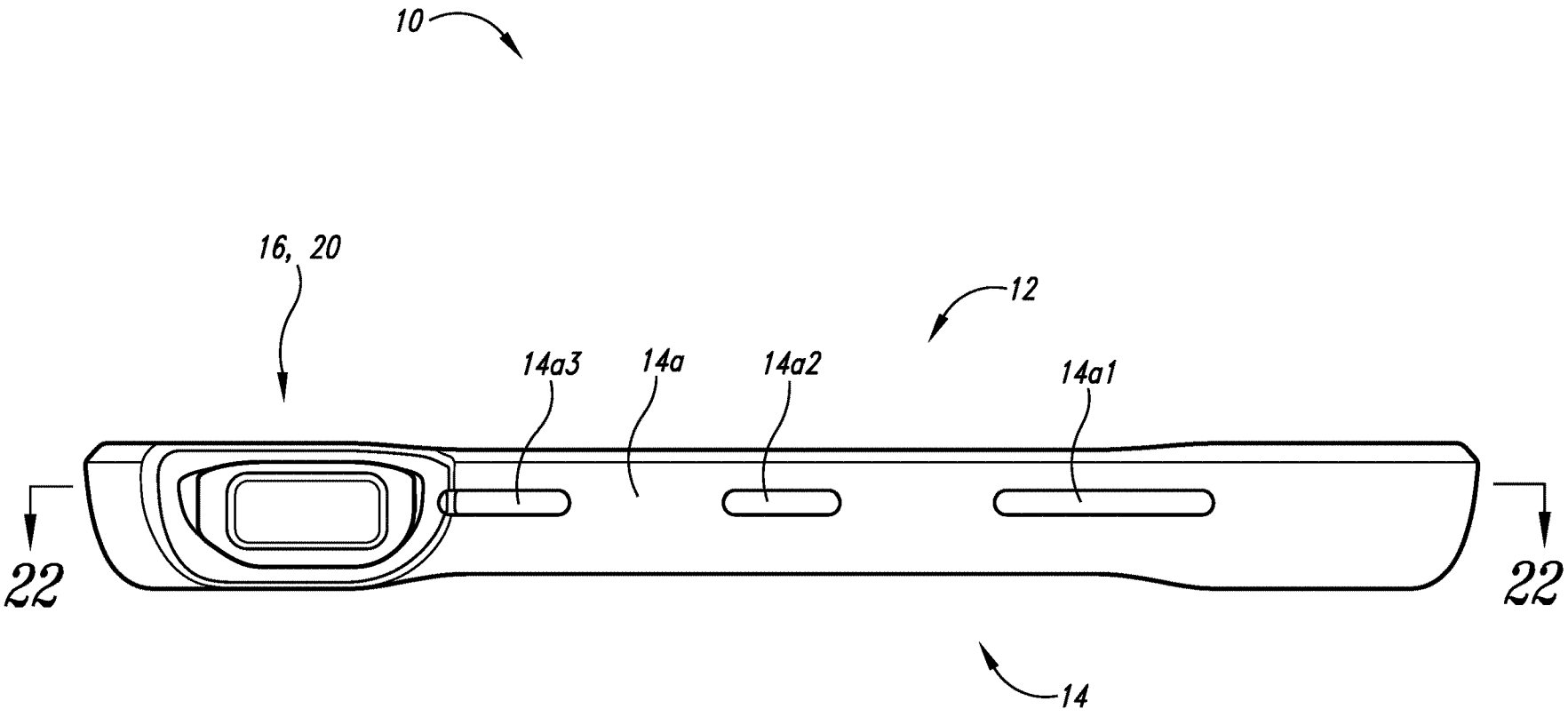
FIG. 21 is a side-elevational view of the case assembly of FIG. 2 coupled with the cover assembly of FIG. 10.

Turning to FIG. 21, depicted therein is a side-elevational view of the case assembly of FIG. 2 coupled with the cover assembly of FIG. 10.

Figure 22:
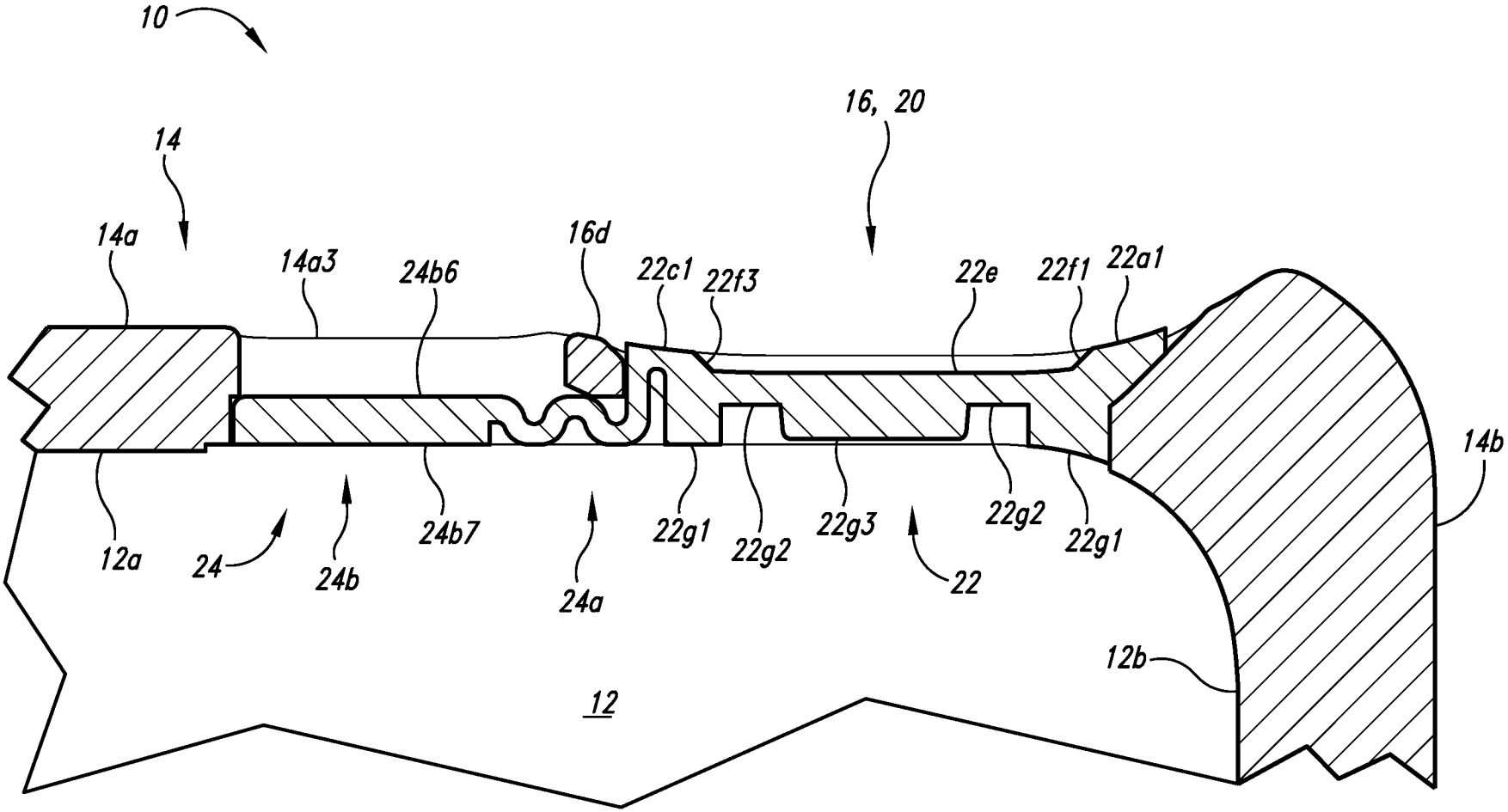
FIG. 22 is a cross-sectional side-elevational view of the cover assembly of FIG. 10 coupled with the case assembly of FIG. 2 taken along the 22-22 cut line of FIG. 21.

Turning to FIG. 22, depicted therein is a cross-sectional side-elevational view of the cover assembly of FIG. 10 coupled with the case assembly of FIG. 2 taken along the 22-22 cut line of FIG. 21.

Figure 23:
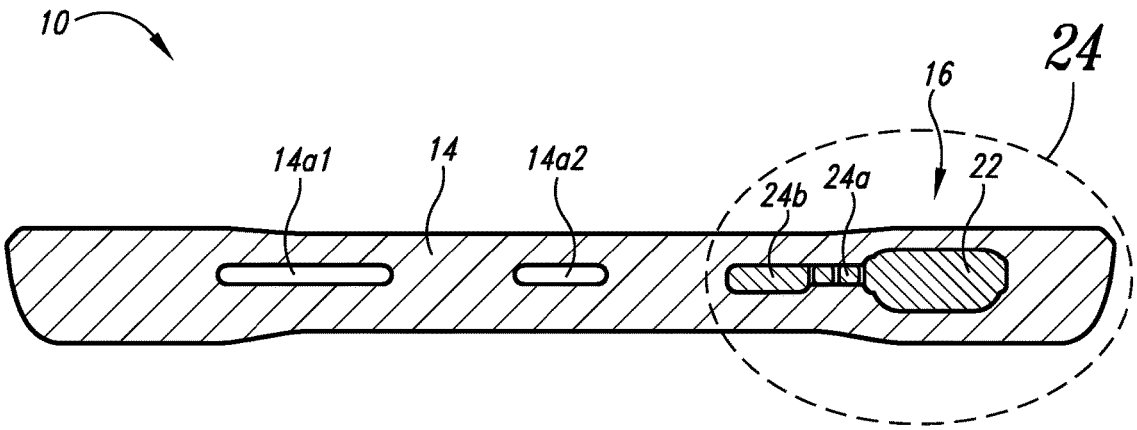
FIG. 23 is a cross-sectional side-elevational view of the cover assembly of FIG. 10 coupled with the case assembly of FIG. 2 taken along the 23-23 cut line of FIG. 20.

Turning to FIG. 23, depicted therein is a cross-sectional side-elevational view of the cover assembly of FIG. 10 coupled with the case assembly of FIG. 2 taken along the 23-23 cut line of FIG. 20.

Figure 24:
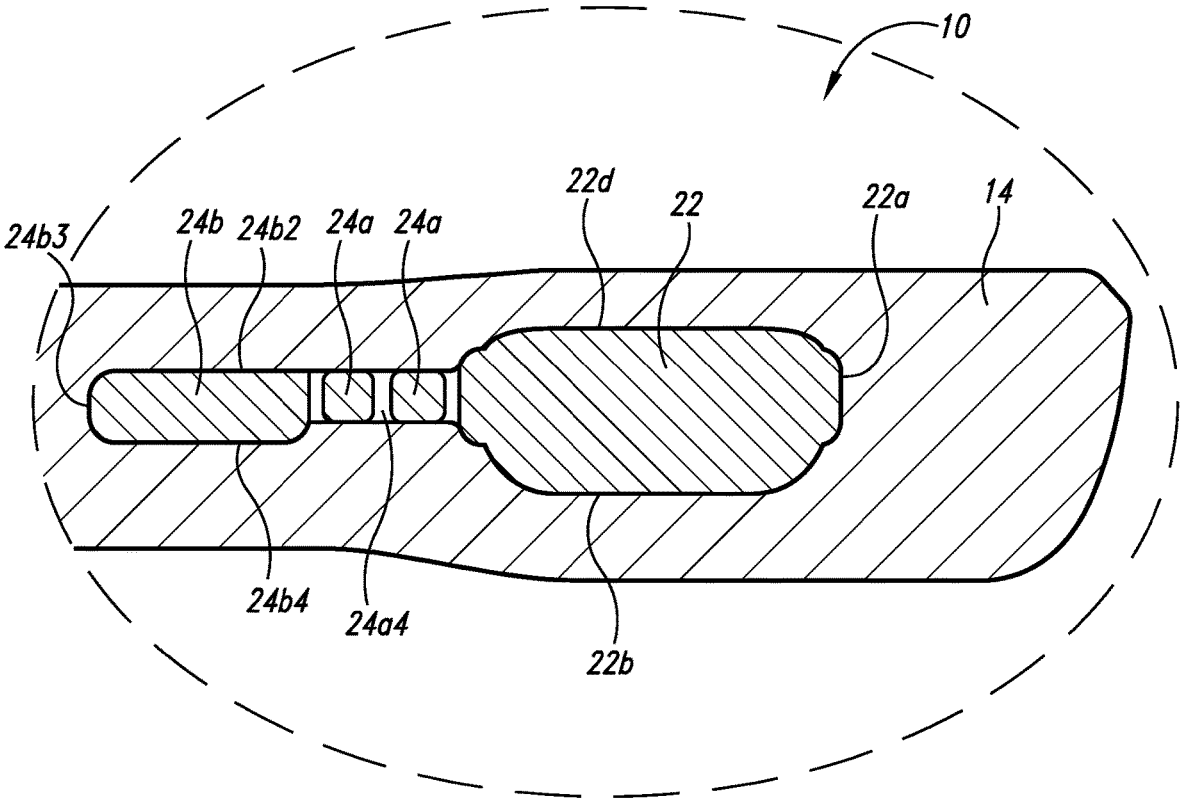
FIG. 24 is an enlarged side-elevational view of a dashed-circle portion of the case assembly labeled "24" shown in FIG. 23.

Turning to FIG. 24, depicted therein is an enlarged side-elevational view of a dashed-circle portion of the case assembly labeled "24" shown in FIG. 23.

Figure 25:
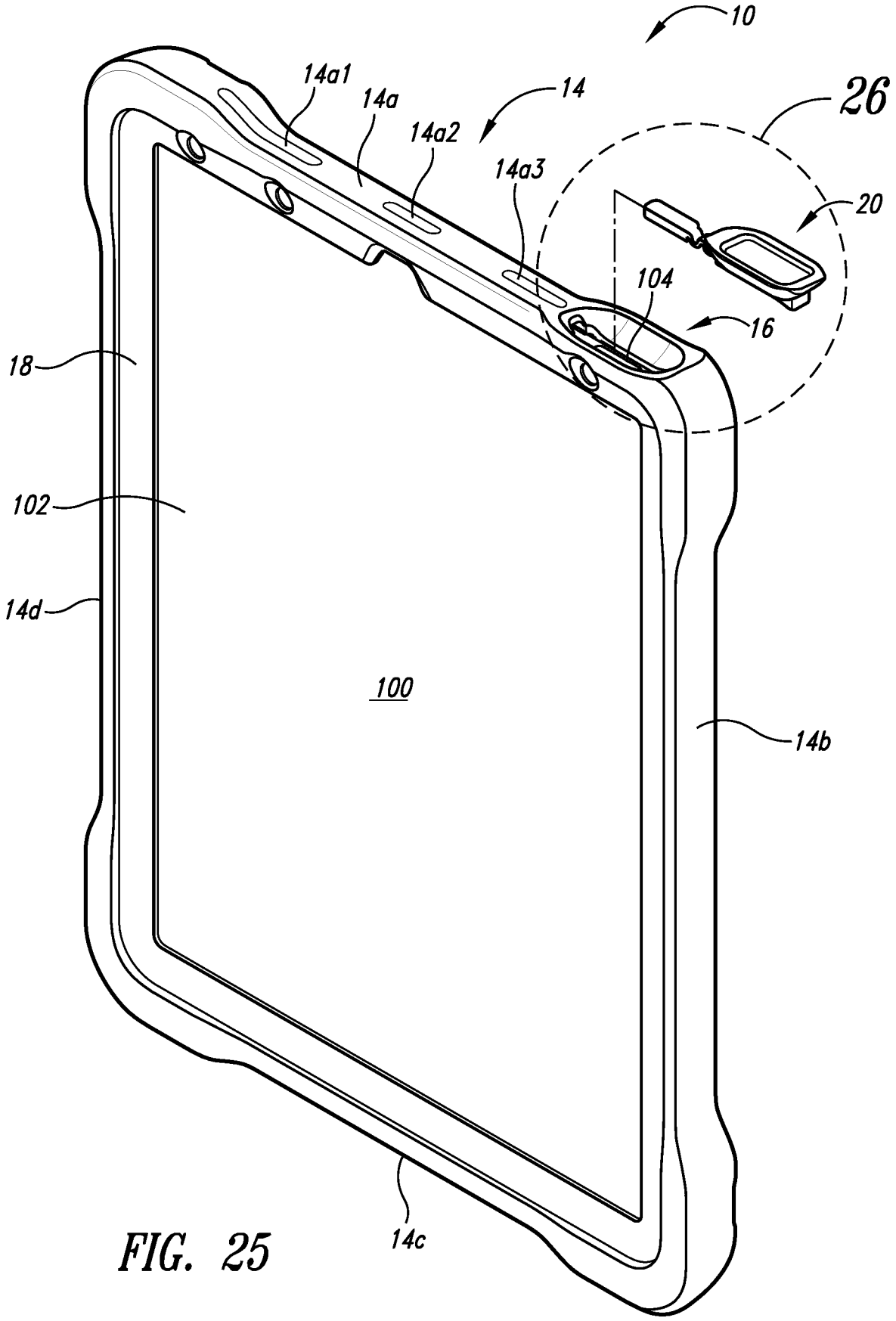
FIG. 25 is a perspective view of the conventional portable electronic device of FIG. 1 coupled with the case assembly of FIG. 2 with the cover assembly of FIG. 10 prior to coupling with the case assembly.

Turning to FIG. 25, depicted therein is a perspective view of the conventional portable electronic device of FIG. 1 coupled with the case assembly of FIG. 2 with the cover assembly of FIG. 10 prior to coupling with the case assembly. In implementations, device case assembly 10 is shown to include frame 18 to retain portable electronic device 100 in device case assembly 10.

Figure 26:
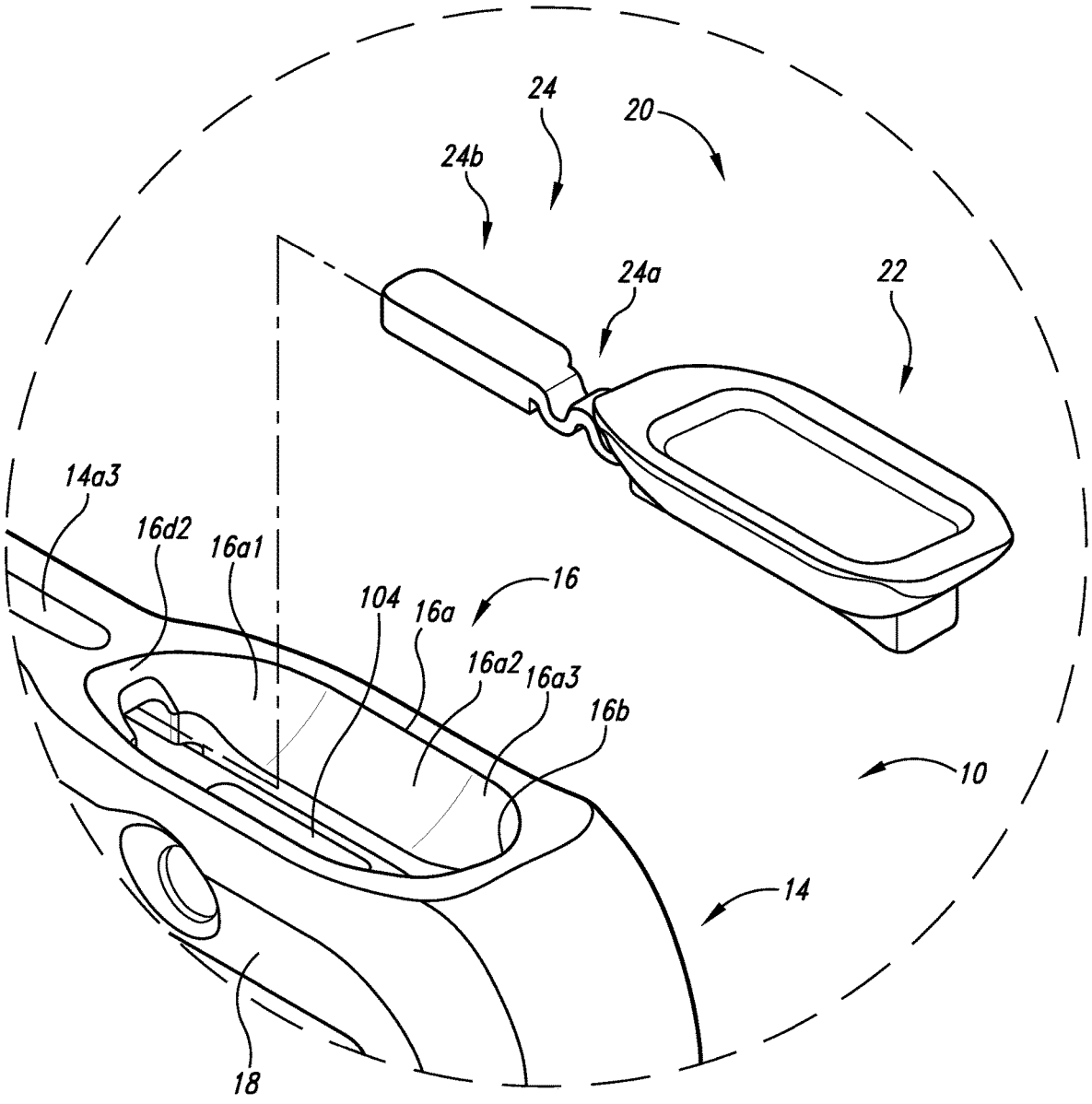
FIG. 26 is an enlarged perspective view of a dashed-circle portion circle portion of the case assembly labeled "26" shown in FIG. 25 of the conventional portable electronic device of FIG. 1 coupled with the case assembly of FIG. 2 with the cover assembly of FIG. 10 prior to coupling with the case assembly.

Turning to FIG. 26, depicted therein is an enlarged perspective view of a dashed-circle portion circle portion of the case assembly labeled "26" shown in FIG. 25 of the conventional portable electronic device of FIG. 1 coupled with the case assembly of FIG. 2 with the cover assembly of FIG. 10 prior to coupling with the case assembly.

Figure 27:
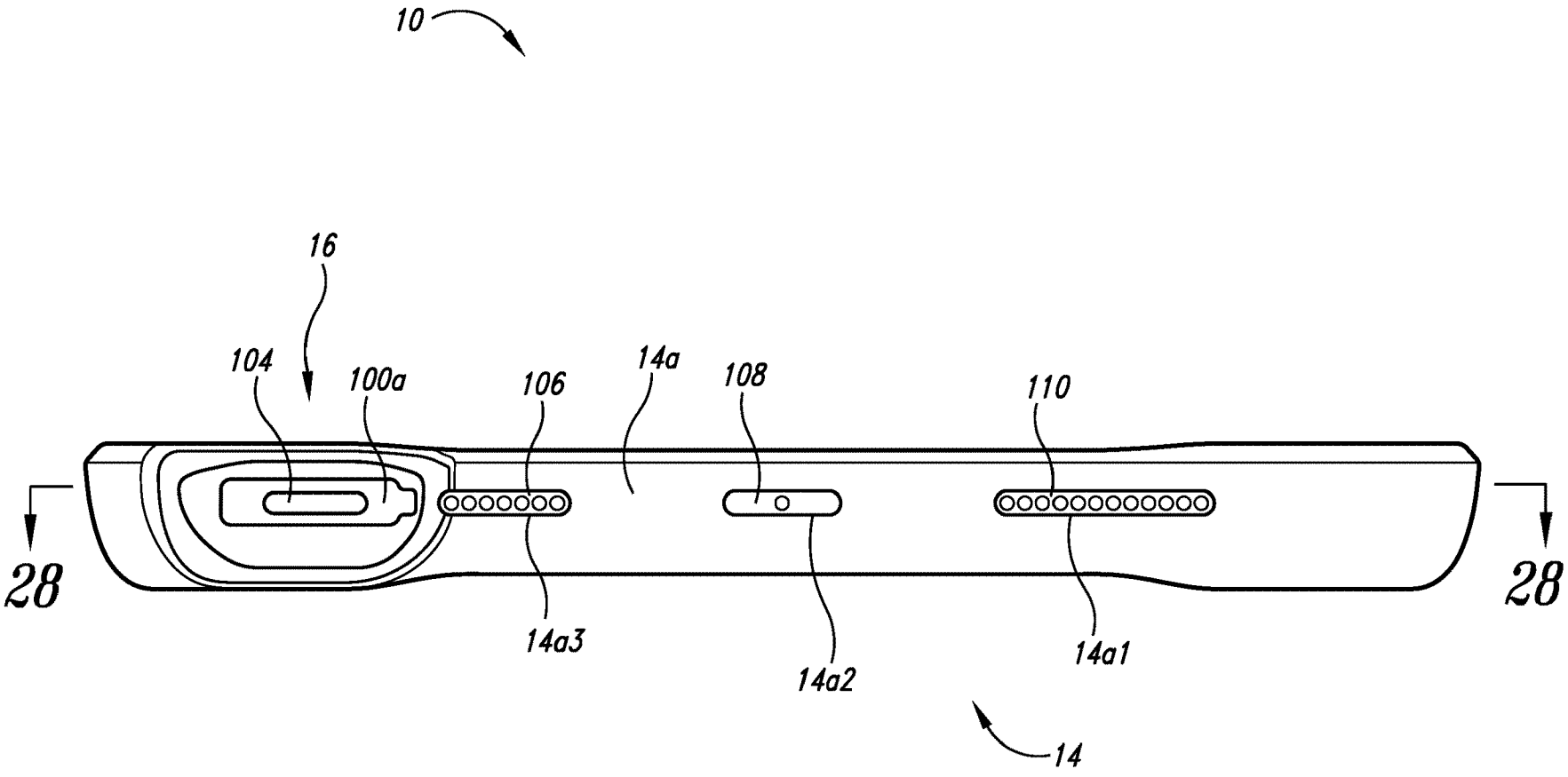
FIG. 27 is a side-elevational view of the case assembly of FIG. 2 coupled with the conventional portable electronic device of FIG. 1.

Turning to FIG. 27, depicted therein is a side-elevational view of the case assembly of FIG. 2 coupled with the conventional portable electronic device of FIG. 1. In implementations, portable electronic device 100 is shown to include tablet feature 106, tablet feature 108, and tablet feature 110 such as speakers, data connections, etc.

Figure 28:
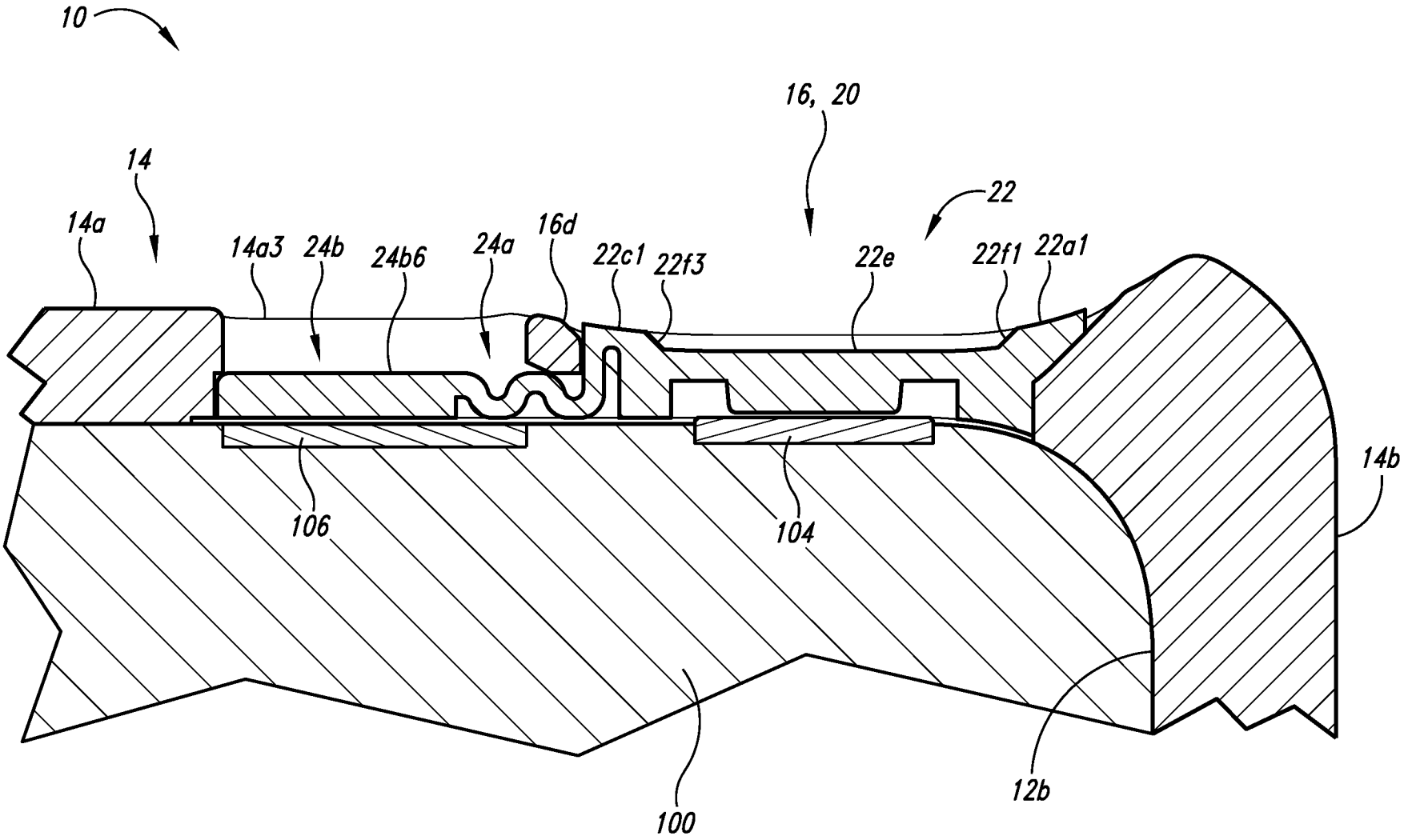
FIG. 28 is a cross-sectional view of the conventional portable electronic device of FIG. 1 and the cover assembly of FIG. 10 coupled with the case assembly of FIG. 2.

Turning to FIG. 28, depicted therein is a cross-sectional view of the conventional portable electronic device of FIG. 1 and the cover assembly of FIG. 10 coupled with the case assembly of FIG. 2.

Figure 29:
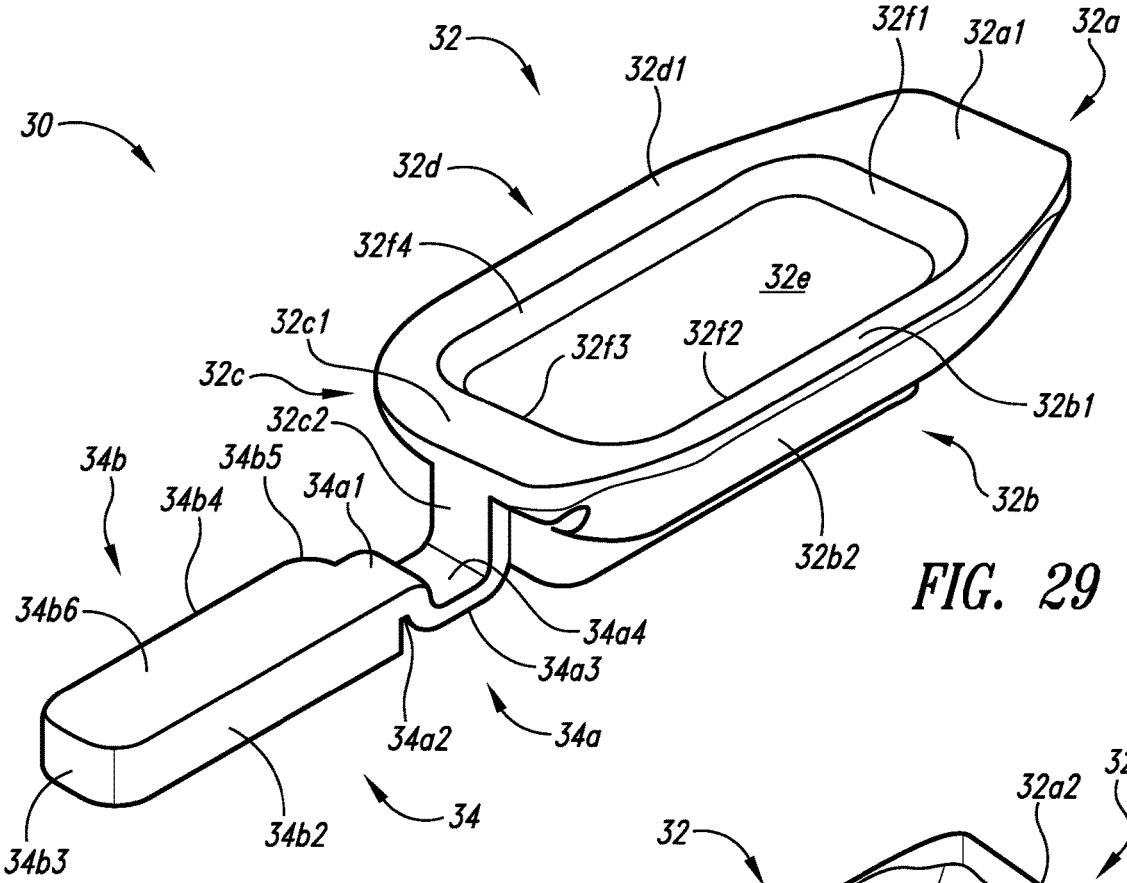
FIG. 29 is an upper-rear perspective view of an alternative cover assembly.

Turning to FIG. 29, depicted therein is an upper-rear perspective view of an alternative cover assembly. In implementations, cover assembly 30 is shown to include cover member 32 and extended member 34. In implementations, cover member 32 is shown to include side 32*a*, side 32*b*, side 32*c*, side 32*d*, and base portion 32*e*. The side 32*a* is shown to include rim portion 32*a*1.

The side 32*b* is shown to include rim portion 32*b*1 and side portion 32*b*2. The side 32*c* is shown to include rim portion 32*c*1 and side portion 32*c*2. The side 32*d* is shown to include rim portion 32*d*1. The base portion 32*e* is shown to be bounded by side 32*f*1, side 32*f*2, side 32*f*3, and side 32*f*4.

In implementations, extended member 34 is shown to include mid portion 34*a* and plug portion 34*b*. The mid portion 34*a* is shown to include ridge portion 34*a*1, groove portion 34*a*2, ridge portion 34*a*3, and groove portion 34*a*4. The plug portion 34*b* is shown to include side portion 34*b*2, end portion 34*b*3, side portion 34*b*4, side portion 34*b*5, and side portion 34*b*6.

Figure 30:
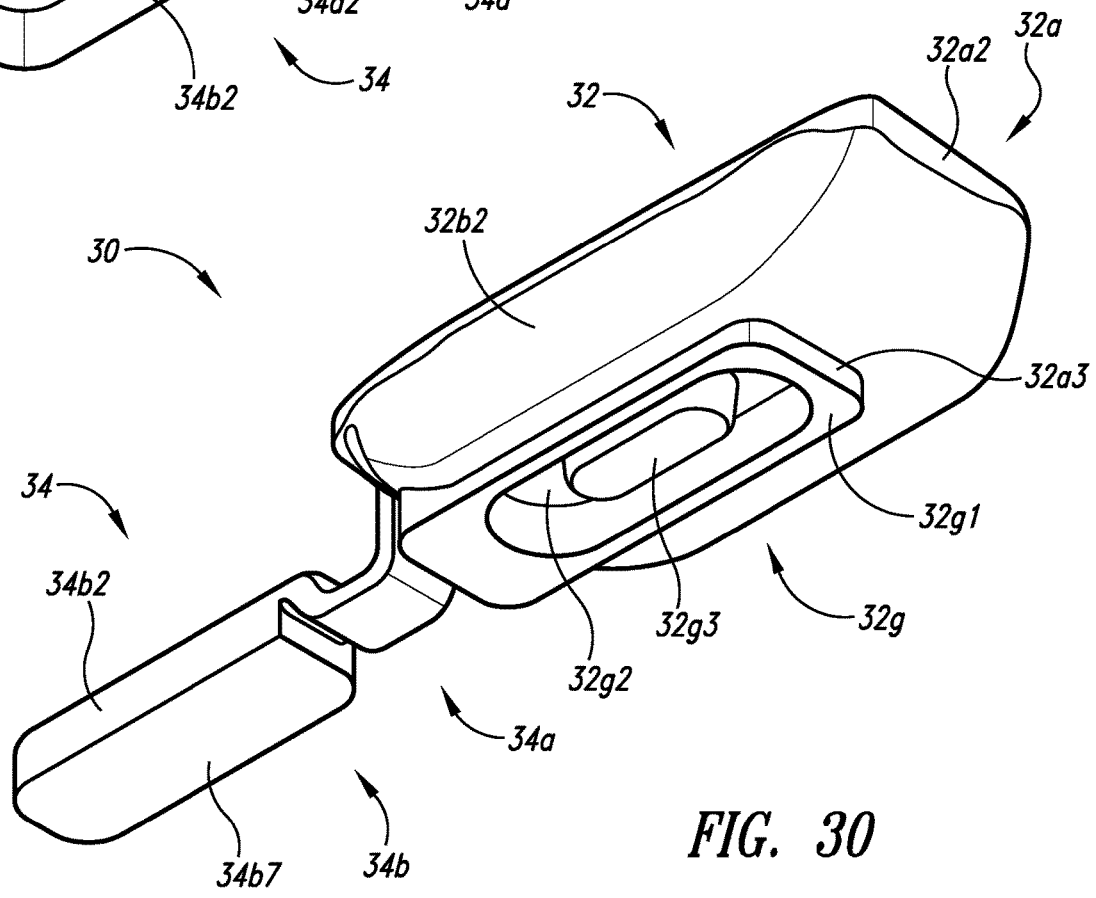
FIG. 30 is a lower-front perspective view of the cover assembly of FIG. 29.

Turning to FIG. 30, depicted therein is a lower-front perspective view of the cover assembly of FIG. 29. In implementations, side 32*a* is shown to include side portion 32*a*2 and side portion 32*a*3. In implementations, cover member 32 is shown to include lower portion 32*g*. The lower portion 32*g* is shown to include lower portion surface 32*g*1, indent portion 32*g*2, and protruded center portion 32*g*3. In implementations, plug portion 34*b* is shown to include side portion 34*b*7.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to,"

"related to," or other past-tense adjectives are generally not intended to exclude such variants, unless context dictates otherwise.

What is claimed is:

1. A system for a portable electronic computing device, the system comprising:

(I) a case section including (A) at least one interior base surface, (B) a first side including at least one first interior wall portion and at least one first exterior side portion with the at least one first interior wall portion angularly extending relative to the at least one interior base surface, (C) a second side including at least one second interior wall portion and at least one second exterior side portion with the at least one second interior wall portion angularly extending relative to the at least one interior base surface, and (D) a third side including at least one third interior wall portion and at least one third exterior side portion with the at least one third interior wall portion angularly extending relative to the at least one interior base surface, wherein the at least one first interior wall portion extends perpendicularly to the second interior wall portion, and wherein the at least one first interior wall portion extends parallel with the at least one third interior wall portion, (E) a first aperture extending in a first direction through the at least one first interior wall portion and the at least one first exterior side portion of the first side, and (F) a channel extending parallel with and between at least a portion of the at least one first interior wall portion and at least a portion of the at least one first exterior side portion of the first side, the channel connecting with and extending from the first aperture in a second direction perpendicular with the first direction; and (II) a cover assembly including (A) a first plug member shaped and sized to detachably couple with the first aperture of the case section, and an elongated member extending from the first plug member, at least a portion of the elongated member shaped and sized to detachably couple with the channel of the case section, the first plug member oriented with the elongated member to allow for simultaneous coupling of the first plug member with the first aperture and the at least a portion of the elongated member with the channel, wherein the case section further includes a second aperture extending in a third direction parallel with the first direction through the at least one first interior wall portion and the at least one first exterior side portion of the first side, the channel connecting with and extending from the second aperture in a fourth direction opposite of the second direction, wherein the elongated member of the cover assembly further includes a second plug portion shaped and sized to detachably couple with the second aperture of the case section, the second plug portion oriented with the first plug member of the first plug member to allow for simultaneous coupling of the first plug member of the cover assembly with the first aperture of the case section and the second plug portion of the elongated member with the second aperture of the case section wherein the elongated member of the cover assembly further includes a mid portion extending between the second plug portion of the elongated member and the first plug member of the cover assembly, the mid portion shaped and sized to allow for simultaneous positioning of the mid portion within the channel, coupling of the first plug member of the cover assembly with the first aperture of the case section and the second plug portion of the elongated member with the second aperture of the case section, wherein (a) the channel of the case section includes a first dimensional width, and (b) the second aperture includes a second dimensional width being larger than the first dimensional width of the channel.

2. The system of claim 1 wherein (a) the mid portion of the elongated member includes a third dimensional width to allow for positioning of the mid portion of the elongated member within the channel, and (b) the second plug portion of the elongated member includes a fourth dimensional width to allow for positioning of the second plug portion in the second aperture, the fourth dimensional width of the second plug portion of the elongated member being larger than the third dimensional width of the mid portion of the elongated member.

3. The system of claim 1 wherein the first aperture of the case section assembly includes an elongated depression with tapered sides.

4. The system of claim 1 wherein the mid portion of the elongated member of the cover assembly includes at least one corrugated portion.

5. A system for a portable electronic computing device, the system comprising:

(I) a case section including (A) at least one interior base surface, (B) a first side including at least one first interior wall portion and at least one first exterior side portion with the at least one first interior wall portion angularly extending relative to the at least one interior base surface, (C) a second side including at least one second interior wall portion and at least one second exterior side portion with the at least one second interior wall portion angularly extending relative to the at least one interior base surface, and (D) a third side including at least one third interior wall portion and at least one third exterior side portion with the at least one third interior wall portion angularly extending relative to the at least one interior base surface, wherein the at least one first interior wall portion extends perpendicularly to the second interior wall portion, and wherein the at least one first interior wall portion extends parallel with the at least one third interior wall portion, (E) a first aperture extending in a first direction through the at least one first interior wall portion and the at least one first exterior side portion of the first side, and (F) a channel extending parallel with and between at least a portion of the at least one first interior wall portion and at least a portion of the at least one first exterior side portion of the first side, the channel connecting with and extending from the first aperture in a second direction perpendicular with the first direction; and (II) a cover assembly including (A) a first plug member shaped and sized to detachably couple with the first aperture of the case section, and an elongated member extending from the first plug member, at least a portion of the elongated member shaped and sized to detachably couple with the channel of the case section, the first plug member oriented with the elongated member to allow for simultaneous coupling of the first plug member with the first aperture and the at least a portion of the elongated member with the channel, wherein the case section further includes a second aperture extending in a third direction parallel with the first direction through the at least one first interior wall portion and the at least one first exterior side portion of the first side, the channel connecting with and extending from the second aperture in a fourth direction opposite of the second direction, wherein the elongated member of the cover assembly further includes a second plug portion shaped and sized to detachably couple with the second aperture of the case section, the second plug portion oriented with the first plug member of the first plug member to allow for simultaneous coupling of the first plug member of the cover assembly with the first aperture of the case section and the second plug portion of the elongated member with the second aperture of the case section, wherein the elongated member of the cover assembly further includes a mid portion extending between the second plug portion of the elongated member and the first plug member of the cover assembly, the mid portion shaped and sized to allow for simultaneous positioning of the mid portion within the channel, coupling of the first plug member of the cover assembly with the first aperture of the case section and the second plug portion of the elongated member with the second aperture of the case section, wherein the channel of the case section includes a first side and a second side and includes a bridge member extending from the first side to the second side.

6. The system of claim 5 wherein the first plug member of the cover assembly includes an elongated member with tapered sides.

7. The system of claim 5 wherein the case section includes at least one of the following materials: rigid plastic, polycarbonate, acrylonitrile butadiene styrene, thermoplastic polymer, polyethylene terephthalate, and nylon, and wherein the cover assembly includes at least one of the following materials: silicone, thermoplastic polyurethane, and thermoplastic elastomer.

8. The system of claim 5 wherein the second plug portion of the elongated member being shaped as a slab.

9. The system of claim 5 wherein the bridge member of the case section being so positioned to allow for simultaneous contact of a portion of the bridge member with a portion of the mid portion of the elongated member of the cover assembly and positioning of at least a portion of the elongated member in the channel.

10. The system of claim 9 wherein the mid portion of the elongated member of the cover assembly includes a corrugated portion.

11. The system of claim 10 wherein the corrugated portion includes at least one ridge, the ridge being positioned to allow simultaneous contact of the ridge with the bridge member and positioning of the at least a portion of the elongated member in the channel.

12. A system for a portable electronic computing device, the system comprising:

(I) a case section including (A) at least one interior base surface, (B) a first side including at least one first interior wall portion and at least one first exterior side portion with the at least one first interior wall portion angularly extending relative to the at least one interior base surface, (C) a second side including at least one second interior wall portion and at least one second exterior side portion with the at least one second interior wall portion angularly extending relative to the at least one interior base surface, and (D) a third side including at least one third interior wall portion and at least one third exterior side portion with the at least one third interior wall portion angularly extending relative to the at least one interior base surface, wherein the at least one first interior wall portion extends perpendicularly to the second interior wall portion, and wherein the at least one first interior wall portion extends parallel with the at least one third interior wall portion such that the case section being configured to receive the first portion of the portable electronic computing device, (E) a first aperture extending in a first direction through the at least one first interior wall portion and the at least one first exterior side portion of the first side, and (F) a channel extending parallel with and between at least a portion of the at least one first interior wall portion and at least a portion of the at least one first exterior side portion of the first side, the channel connecting with and extending from the first aperture in a second direction perpendicular with the first direction, wherein the case section further includes a second aperture extending in a third direction parallel with the first direction through the at least one first interior wall portion and the at least one first exterior side portion of the first side, the channel connecting with and extending from the second aperture in a fourth direction opposite of the second direction, wherein (a) the channel of the case section includes a first dimensional width, and (b) the second aperture includes a second dimensional width being larger than the first dimensional width of the channel.

13. The system of claim 12 wherein the channel of the cover section includes a first side and a second side and includes a bridge member extending from the first side to the second side.

* * * * *